US009421766B2

(12) United States Patent
Owaku et al.

(10) Patent No.: US 9,421,766 B2
(45) Date of Patent: Aug. 23, 2016

(54) FLOW PATH MEMBER, LIQUID EJECTING HEAD, AND LIQUID EJECTING APPARATUS

(71) Applicant: SEIKO EPSON CORPORATION, Tokyo (JP)

(72) Inventors: Takeshi Owaku, Shiojiri (JP); Hiroki Miyajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/627,100

(22) Filed: Feb. 20, 2015

(65) Prior Publication Data

US 2015/0251418 A1 Sep. 10, 2015

(30) Foreign Application Priority Data

Mar. 4, 2014 (JP) ..... 2014-042039

(51) Int. Cl.
*B41J 2/14* (2006.01)

(52) U.S. Cl.
CPC .... *B41J 2/14233* (2013.01); *B41J 2002/14362* (2013.01); *B41J 2002/14419* (2013.01)

(58) Field of Classification Search
CPC .... B41J 2/1433; B41J 2/14233; B41J 2/1612; B41J 2002/14362; B41J 2002/14419
USPC ..... 347/65
See application file for complete search history.

(56) References Cited

U.S. PATENT DOCUMENTS

2006/0028519 A1* 2/2006 Nakamura ..... B41J 2/17523 347/87
2008/0086077 A1* 4/2008 Seto ..... A61B 17/3203 604/48
2011/0157275 A1* 6/2011 Kubota ..... B41J 2/14209 347/37

FOREIGN PATENT DOCUMENTS

JP 201213108 A * 7/2012
JP 2012131082 A * 7/2012
JP 2012-206424 10/2012

OTHER PUBLICATIONS

Ataka M, "MachineTranslationof[JP2012-131082A].pdf", Jul. 12, 2012.*
Ataka M., MachineTranslationofJP2012-131082A.pdf, Jul. 12, 2012.*

* cited by examiner

*Primary Examiner* — Geoffrey Mruk
*Assistant Examiner* — Scott A Richmond
(74) *Attorney, Agent, or Firm* — Workman Nydegger

(57) ABSTRACT

A flow path member includes a cover divided into a base unit and a cover unit. Flow path grooves are provided on one side of faces of the cover unit and the base unit which face each other. The flow path grooves extend in a first direction and are aligned in a second direction. An elastic sealing member is arranged between the facing faces and configures a part of a flow path wall face by covering the flow path grooves. An abutting unit is provided on one side of the base unit and the cover unit, protrudes toward the other side, and comes into contact with the other side. The abutting unit may be provided on both sides of the flow path groove in any one direction and may be extended along the other direction. The base unit and the cover unit may be fixed using a fastening member.

17 Claims, 17 Drawing Sheets

FLOW PATH MEMBER, LIQUID EJECTING HEAD, AND LIQUID EJECTING APPARATUS

CROSS-REFERENCE TO RELATED APPLICATIONS

The present application claims priority to Japanese Patent Application No. 2014-042039 filed on Mar. 4, 2014, which is hereby incorporated by reference in its entirety.

TECHNICAL FIELD

The present invention relates to a flow path member for supplying liquid to a head main body of a liquid ejecting head which ejects liquid from nozzle openings, the liquid ejecting head including the flow path member, and a liquid ejecting apparatus.

RELATED ART

An ink jet recording head which is an example of a liquid ejecting head performs recording, or the like, on a medium such as paper using ink droplets by ejecting ink droplets from nozzle openings, by causing a pressure change in a pressure generation chamber which communicates with the nozzle openings. As such an ink jet recording head, a recording head in which a flow path member for supplying ink to a head main body including nozzle openings is provided in a valve unit (back-pressure control unit) has been proposed (for example, refer to JP-A-2012-206424).

Such a valve unit is configured so that a main body of a flow path member is held inside a cover. In addition, in the main body of the flow path member, a flow path is provided, and a pressure adjusting chamber and a valve which is open or closed due to a pressure change in the pressure adjusting chamber are provided in the middle of the flow path. In addition, a film holding unit which holds a film member demarcating the pressure adjusting chamber is open to the air through an atmosphere open path. In addition, in the atmosphere open path, a meandering path is covered using a sealing member, and the meandering path is sealed using the sealing member by interposing the sealing member with two cover members when the cover members are fastened (refer to JP-A-2012-206424). In addition, in a structure in JP-A-2012-206424, since the two cover members are fastened, and the main body of the flow path member in the inside is appropriately pressed, a first abutting unit is provided, and second abutting units are fastened until coming into contact with each other.

However, in the structure in JP-A-2012-206424, there is a problem in that a crushing amount of the sealing member which seals the meandering path becomes uneven, and due to excessive crushing, exudation (bleeding) of oil from the sealing member which is formed of rubber occurs, and the meandering path is blocked with the oil.

In addition, such a problem is not limited to an ink jet recording head, and also occurs in a liquid ejecting head which ejects liquid other than ink.

SUMMARY

An advantage of some aspects of the invention is to provide a flow path member in which excessive crushing is prevented by suppressing an uneven crushing amount of a sealing member which seals a meandering path, a liquid ejecting head, and a liquid ejecting apparatus.

According to an aspect of the invention, there is provided a flow path member which includes a cover which is divided into a base unit and a cover unit; flow path grooves which are provided on one side of facing faces of the cover unit and the base unit which face each other, are extended in a first direction in the facing faces, and are aligned in a second direction intersecting the first direction; an elastic sealing member which is arranged between the facing faces, and configures a part of a flow path wall face by covering the flow path grooves; and an abutting unit which is provided on one side of the facing faces of the base unit and the cover unit, protrudes toward the other side, and comes into contact with the other side on a face, in which the abutting units are provided on both sides of the flow path groove in any one direction of the first direction and the second direction, is extended along the other direction, and in which the base unit and the cover unit are fixed using a fastening member.

In this case, since the abutting units are provided on facing faces of both sides of the flow path groove, a degree of fastening using the fastening member becomes uniform, and it is possible to reduce unevenness of a crushing amount of the sealing member.

In the flow path member, it is preferable that the flow path groove be provided in a region which is surrounded with a first side in the first direction, and a second side in the second direction which is longer than the first side, and the abutting units be provided on both sides in a direction to which the second side is extended. In this case, the crushing amount of the sealing member with respect to the entire flow path groove becomes more uniform.

In the flow path member, it is preferable that the abutting unit be extended to the same dimension as at least a dimension of extending or aligning the flow path groove. In this case, the crushing amount of the sealing member with respect to the entire flow path groove becomes more uniform.

In the flow path member, it is preferable that a main body of the flow path member which has a layered structure in which flow paths of liquid are formed inside the cover be provided, and the main body of the flow path member include at least one back-pressure control unit. In this case, it is possible to perform atmosphere opening of the back-pressure control unit to the atmospheric pressure side through the flow path groove.

In the flow path member, it is preferable that a second abutting unit which comes into contact with other side on a face by protruding towards the other side be provided on one side of facing faces of the cover unit and the base unit which face each other corresponding to a portion at which the fastening member is provided. In this case, it is possible to control a fastening amount of the fastening member in a second abutting unit, and the crushing amount of the sealing member with respect to the entire flow path groove becomes more uniform.

According to another aspect of the invention, there is provided a liquid ejecting head which includes the flow path member. In this case, an abutting unit is provided on facing faces on both sides of a flow path groove, a degree of fastening using a fastening member becomes uniform, and it is possible to realize a liquid ejecting head which includes a flow path member in which unevenness of a crushing amount of a sealing member is reduced.

According to still another aspect of the invention, there is provided a liquid ejecting apparatus which includes the liquid ejecting head. In this case, an abutting unit is provided on facing faces on both sides of a flow path groove, degree of fastening using a fastening member becomes uniform, and it is possible to realize a liquid ejecting apparatus which includes a flow path member in which unevenness of a crushing amount of a sealing member is reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

First Embodiment

Figure 1:
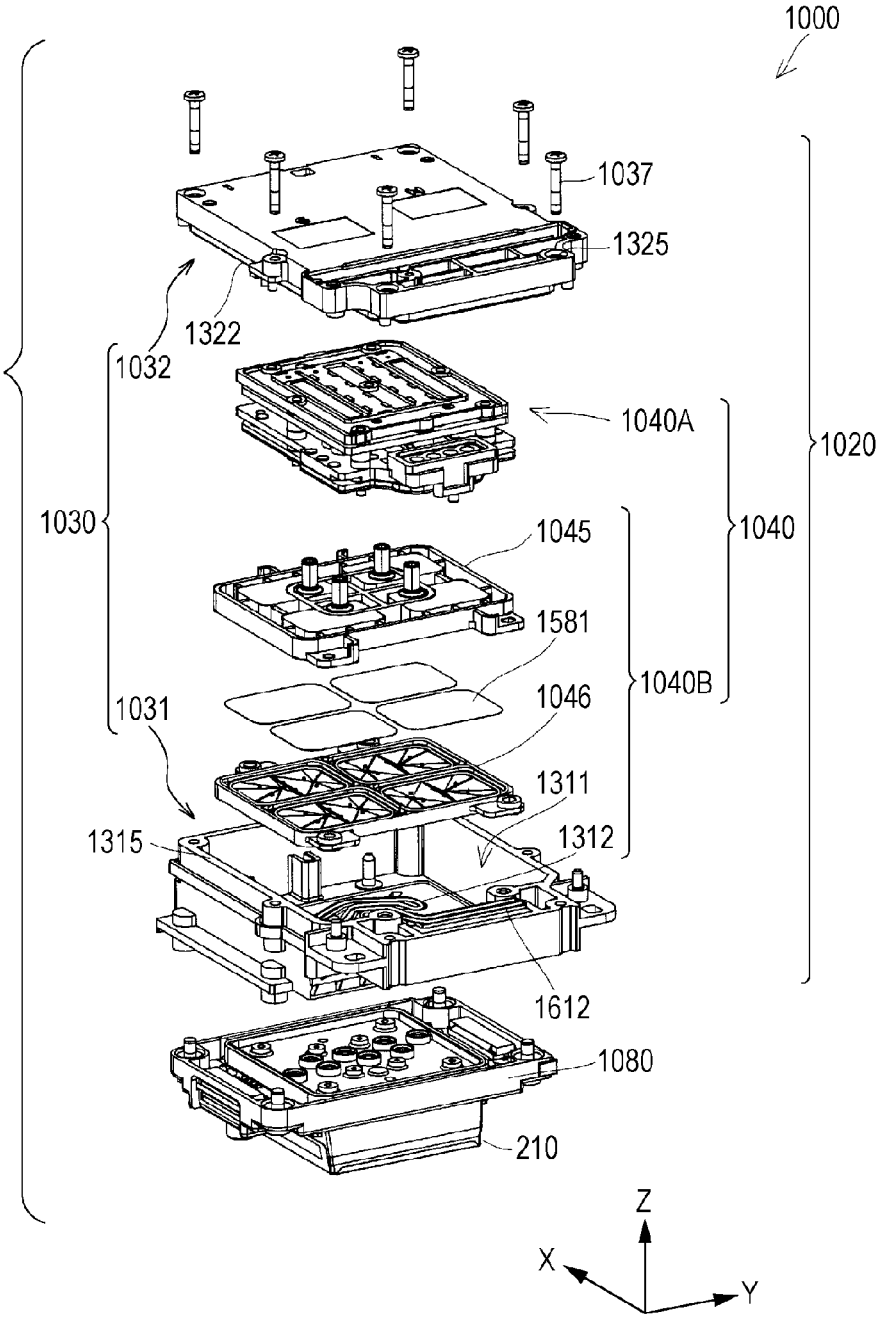
FIG. 1 is an exploded perspective view of a recording head according to a first embodiment of the invention.
Figure 2:
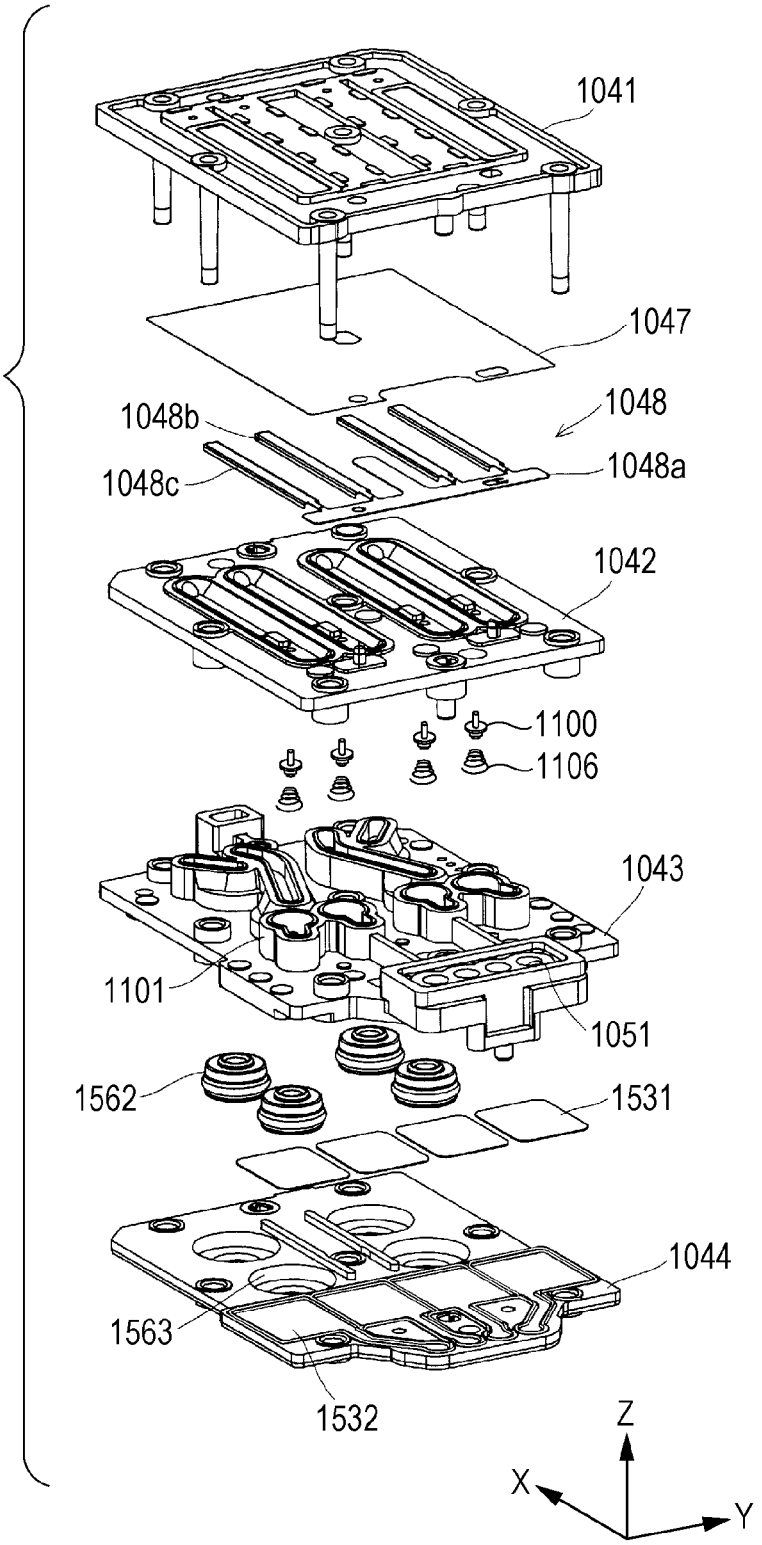
FIG. 2 is an exploded perspective view of a first main body of a flow path member according to the first embodiment.
Figure 3A:
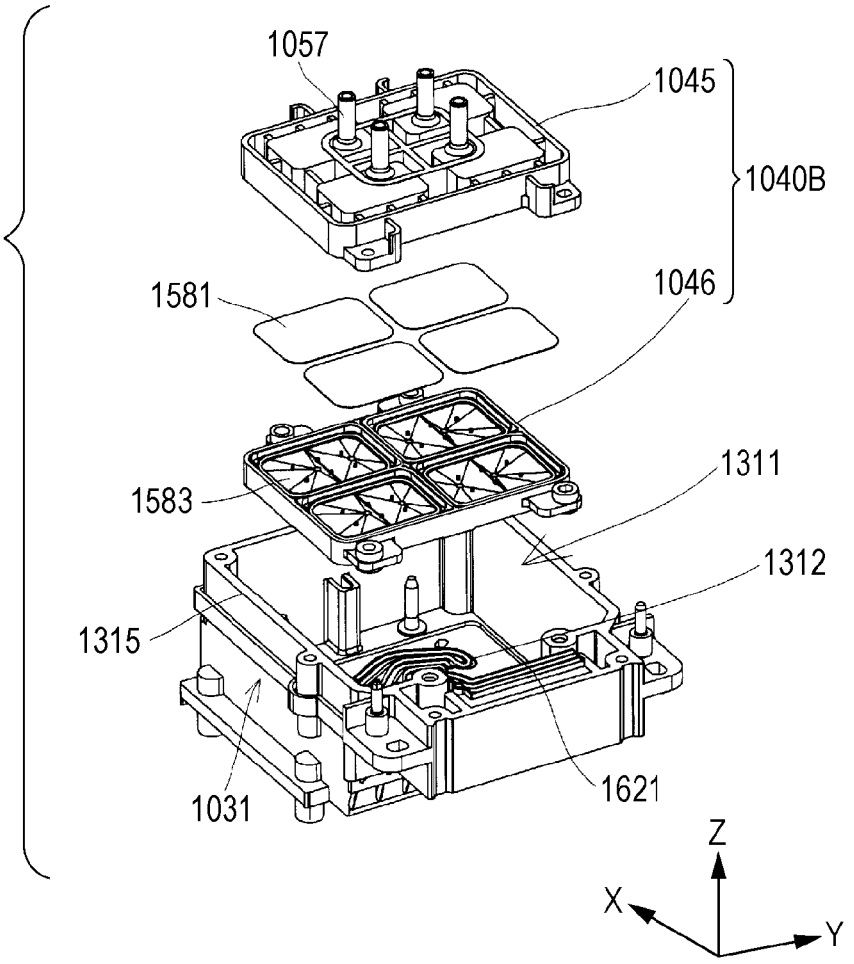
FIGS. 3A and 3B are exploded perspective views of a second main body of the flow path member according to the first embodiment.
Figure 3B:
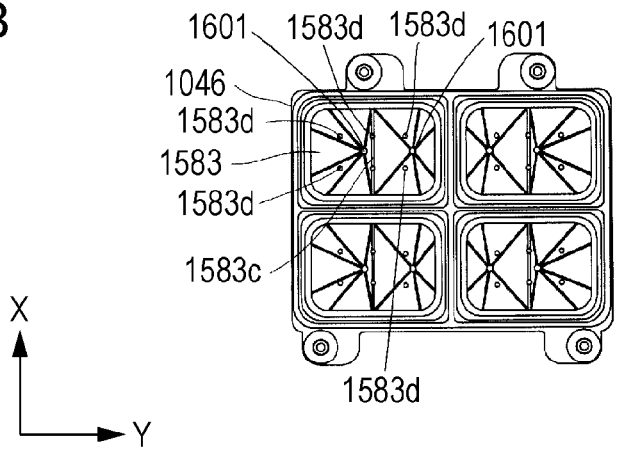
Figure 4:
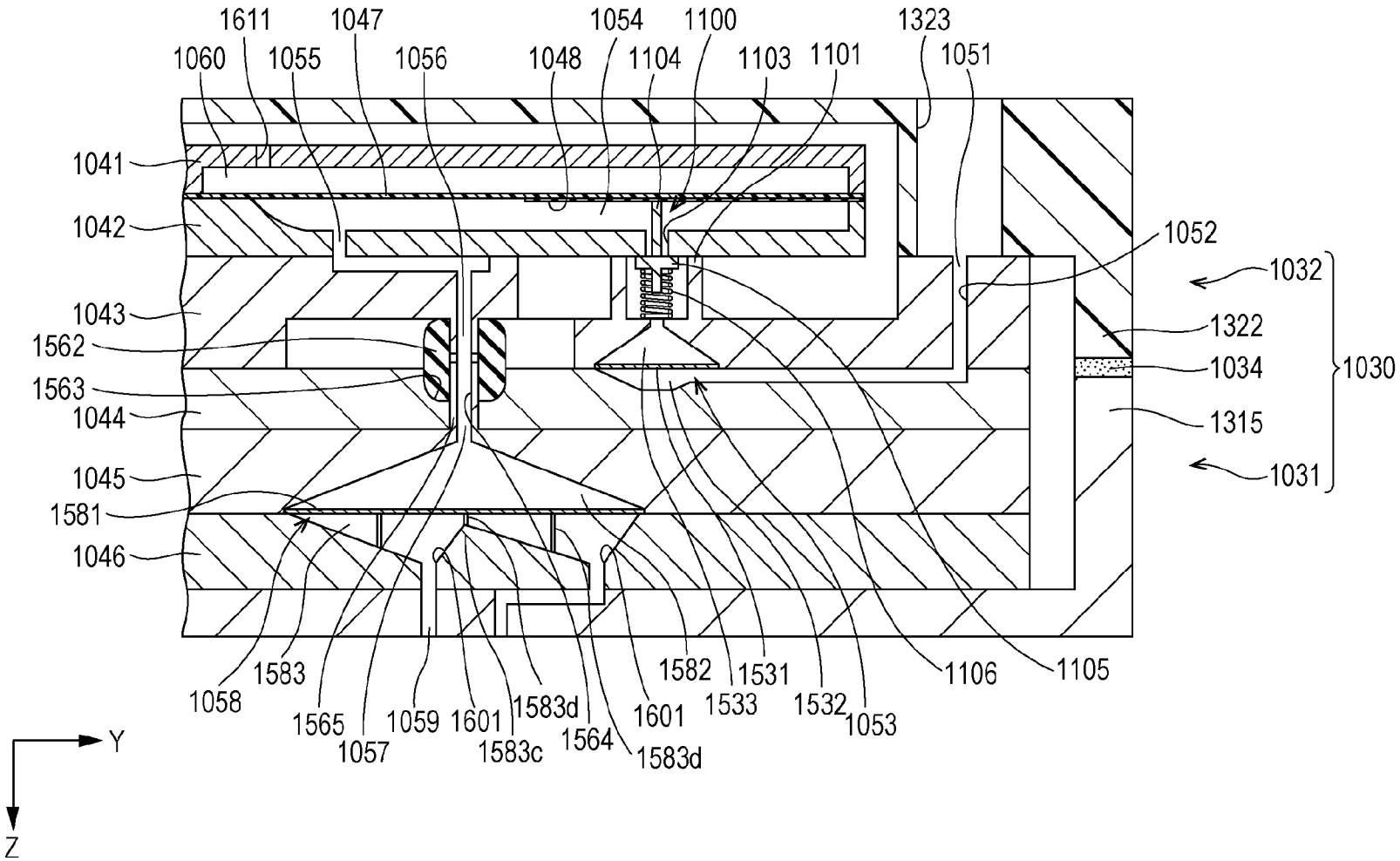
FIG. 4 is a schematic cross-sectional view of the flow path member according to the first embodiment.
Figure 5A:
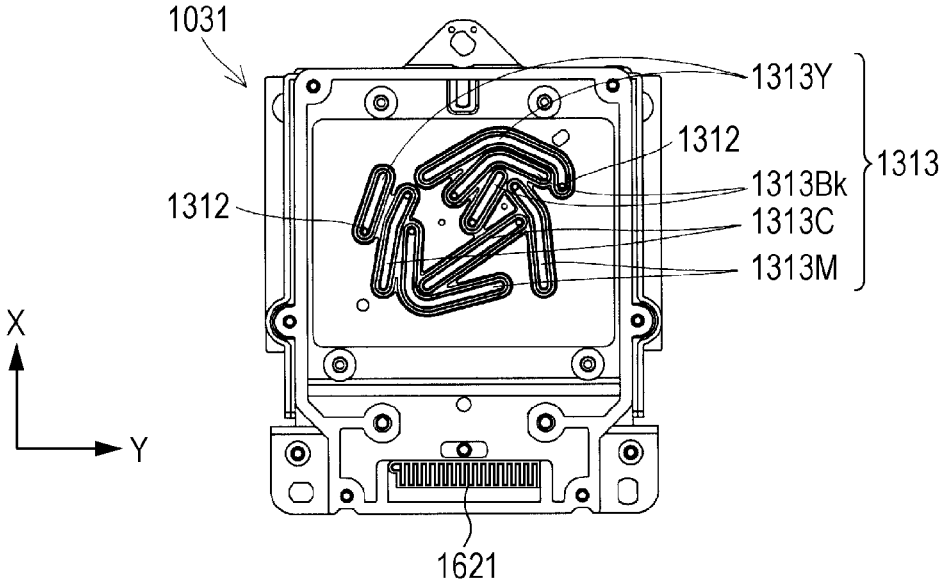
FIGS. 5A and 5B are a plan view and a rear view of a base unit of the flow path member according to the first embodiment.
Figure 5B:
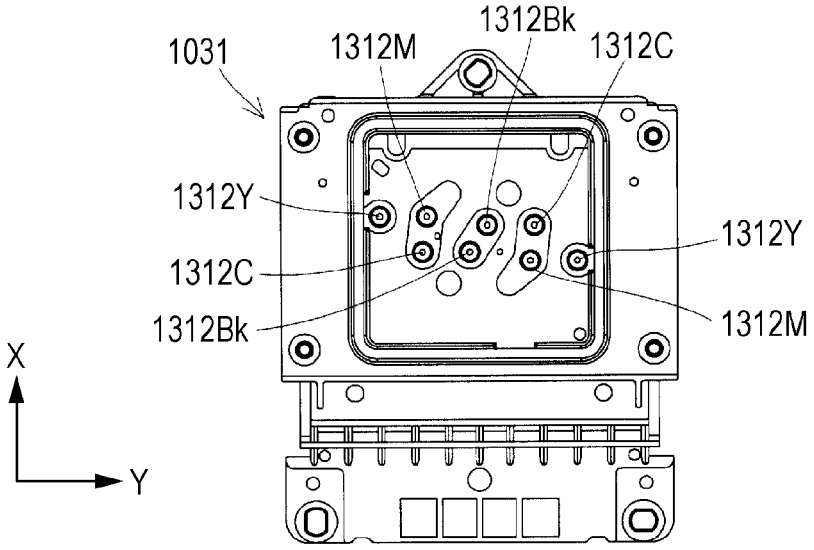
Figure 6A:
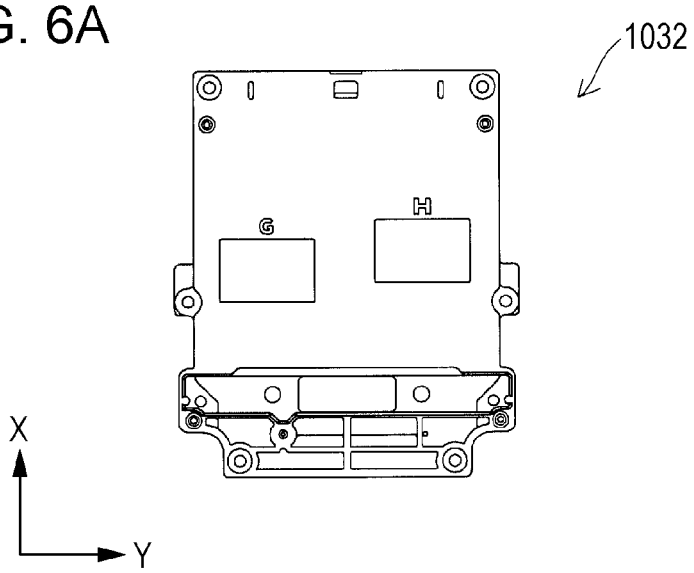
FIGS. 6A and 6B are a plan view and a rear view of a cover unit of the flow path member according to the first embodiment.
Figure 6B:
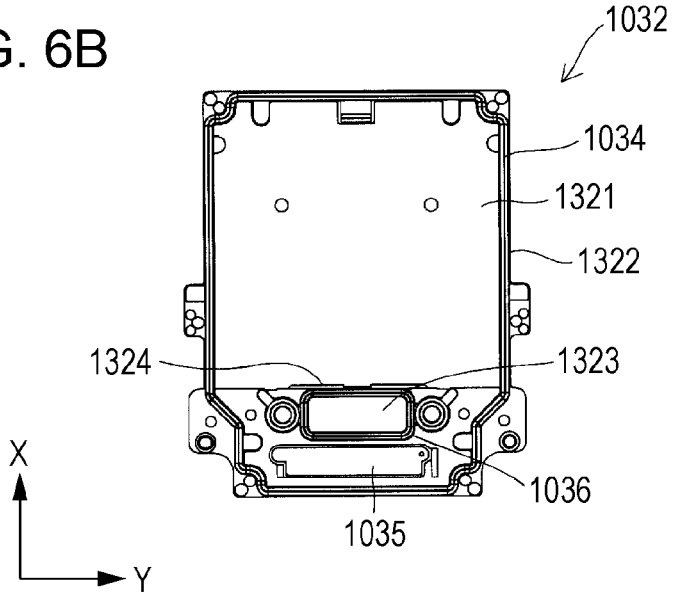
Figure 7:
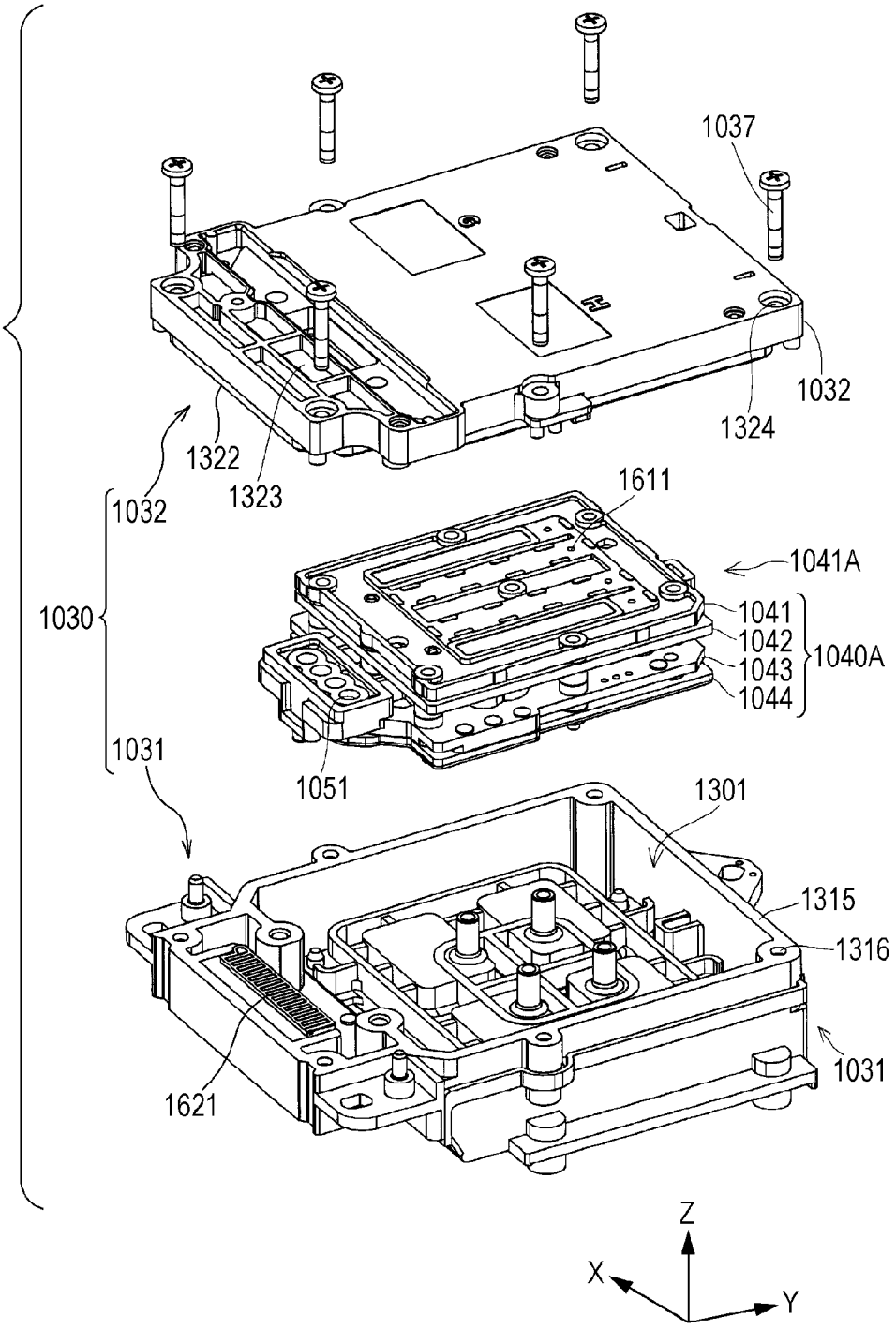
FIG. 7 is an exploded perspective view of the flow path member according to the first embodiment.

FIG. 1 is an exploded perspective view of an ink jet recording head which is an example of a liquid ejecting head according to a first embodiment of the invention, FIG. 2 is an exploded perspective view of a first main body of a main body of a flow path member, FIGS. 3A and 3B are an exploded perspective view and a perspective view of a main portion of a second main body of the main body of the flow path member, FIG. 4 is a cross-sectional view which schematically illustrates a cross section of the flow path member, FIGS. 5A and 5B are a plan view and a rear view of a base unit, FIGS. 6A and 6B are a plan view and a rear view of a cover unit, and FIG. 7 is an exploded perspective view of the flow path member.

As illustrated in FIG. 1, an ink jet recording head 1000 which is an example of a liquid ejecting head according to the first embodiment of the invention includes a back-pressure control unit 1020 which is a flow path member, a circuit board 1070 which is provided on a base of the back-pressure control unit 1020, a head case 1080 which is provided on the side opposite to the back-pressure control unit 1020 of the circuit board 1070, and a head main body 210 which is fixed to the head case 1080.

The back-pressure control unit 1020 is a flow path member which supplies ink from a liquid storage unit such as an ink tank in which external ink is stored to the head main body 210.

Here, the back-pressure control unit 1020 will be described in detail. The back-pressure control unit 1020 includes a cover 1030 which is formed of a hollow box-shaped member, and a main body of the flow path member 1040 which is provided inside the cover 1030.

The cover 1030 includes a base unit 1031 and a cover unit 1032 which are vertically separated. The base unit 1031 includes a first holding unit 1311 which has a concave shape which opens to the cover unit 1032 side.

In addition, a plurality of supply ports 1312 which supply ink to the head main body 210 by penetrating the head main body in the thickness direction are provided on a base of the first holding unit 1311 of the base unit 1031. According to the embodiment, eight supply ports 1312 are provided on the base of the base unit 1031 (refer to FIGS. 5A and 5B).

As illustrated in FIGS. 1, 2 and 4, the cover unit 1032 is formed in a size which covers the first holding unit 1311 of the base unit 1031, and includes a concave-shaped second holding unit 1321 which is open to the base unit 1031 side by facing the first holding unit 1311 of the base unit 1031.

In addition, when the base unit 1031 and the cover unit 1032 cause the first holding unit 1311 and the second holding unit 1321 to be fixed by facing each other, a holding unit 1033 which is a space demarcated by the first holding unit 1311 and the second holding unit 1321 is formed inside the cover unit 1032.

Here, a first wall portion 1315 which demarcates a side face of the first holding unit 1311 is provided in the base unit 1031, as illustrated in FIGS. 4 to 6B. In addition, a second wall portion 1322 which demarcates a side face of the second holding unit 1321 is provided in the cover unit 1032. In addition, the base unit 1031 and the cover unit 1032 are fixed by causing a tip end face of the first wall portion 1315 and a tip end face of the second wall portion 1322 to come into contact with each other through a first sealing portion 1034. That is, the first sealing portion 1034 which is formed of rubber, elastoma, or the like, is interposed between the first wall portion 1315 and the second wall portion 1322. As a matter of course, the first sealing portion 1034 may be a bonding portion using heat welding or an adhesive. In addition, the base unit 1031 and the cover unit 1032 are fixed when a fastening member 1037 such as a screw, which is illustrated in FIG. 1, is inserted thereto from the cover unit 1032 side, and by screwing the fastening member 1037 to the base unit 1031.

As illustrated in FIGS. 1 to 7, according to the embodiment, the main body of the flow path member 1040 which is held by the holding unit 1033 of the cover 1030 includes a first main body 1040A which is configured by stacking a first flow path member 1041 which is provided on the cover 1030 side, a second flow path member 1042 which is provided on the base unit 1031 side of the first flow path member 1041, a third flow path member 1043 which is provided on the base unit 1031 side of the second flow path member 1042, and a fourth flow path member 1044 (which is provided on the base unit 1031 side of the second flow path member 1042). In addition, the main body of the flow path member includes a second main body 1040B which is configured of a fifth flow path member 1045 which is attached to the base unit 1031, and a sixth flow path member 1046 which is provided between the fifth flow path member 1045 and the base unit 1031 (refer to FIGS. 3A and 3B).

The respective first flow path member 1041, the second flow path member 1042, the third flow path member 1043, the fourth flow path member 1044, the fifth flow path member 1045, and the sixth flow path member 1046 are formed of a plate-shaped member which is configured of a resin material, a metallic material, or the like. In addition, the fifth flow path member 1045 and the sixth flow path member 1046 are attached to the base unit 1031, and the first main body 1040A which is configured of the first flow path member 1041, the second flow path member 1042, the third flow path member 1043, and the fourth flow path member 1044 is held in the holding unit 1033 of the cover 1030 in the stacked state. In addition, according to the embodiment, the first flow path member 1041, the second flow path member 1042, the third flow path member 1043, and the fourth flow path member 1044 are bonded to each other using an adhesive.

In the main body of the flow path member 1040 which is formed of the first main body 1040A configured of the first flow path member 1041, the second flow path member 1042, the third flow path member 1043, and the fourth flow path member 1044, and the second main body 1040B which is configured of the fifth flow path member 1045 and the sixth flow path member 1046, a liquid flow path which supplies ink from a liquid storage unit in which external ink is stored to the head main body 210 is provided.

Specifically, as illustrated in FIG. 2, the first main body 1040A includes an introduction path 1052 which has a connection port 1051 to which the other end portion of a supply tube (not illustrated) which is a tubular member such as a tube of which one end side is connected to the liquid storage unit is connected, a filtering chamber for introduction 1053 which eliminates dust or foreign substances such as air bubbles which are contained in liquid from the introduction path 1052, a pressure adjusting chamber 1054 which is a liquid chamber to which liquid which passes through the introduction filter chamber 1053 is supplied, an outflow path 1055 through which liquid in the pressure adjusting chamber 1054 is flown out to the head side, and an outflow port 1056 which flows out the liquid on the outflow path 1055.

Meanwhile, the second main body 1040B includes a second introduction path 1057 which communicates with the outflow path 1055, a filtering chamber 1058 for filtering liquid which is introduced from the second introduction path 1057, and a supply path 1059 which supplies liquid from the filtering chamber 1058 to the head main body 210.

Here, the connection port 1051 is provided on a top face of the third flow path member 1043 by opening into the inside of an opening portion 1323 of the cover unit 1032. A plurality of the connection ports 1051 are provided corresponding to a plurality of inks. According to the embodiment, four connection ports 1051 are provided (refer to FIGS. 1 and 2).

The introduction path 1052 including such connection ports 1051 is configured of a flow path which penetrates the third flow path member 1043 or the fourth flow path member 1044, a flow path between the second flow path member 1042 and the first flow path member 1041, a flow path between the third flow path member 1043 and the fourth flow path member 1044, and the like.

Here, the filtering chamber for introduction 1053 which is provided on the introducing path 1052 which has the connection port 1051 includes a filter member 1531 which is interposed between the third flow path member 1043 and the fourth flow path member 1044, a filtering chamber 1532 on the upstream side, and a filtering chamber 1533 on the downstream side, and the filtering chamber 1533 on the downstream side communicates with the pressure adjusting chamber 1054.

Incidentally, according to the embodiment, as illustrated in FIGS. 2 to 3B, four connection ports 1051 are provided, four introduction paths 1052 are provided corresponding to the four connection ports 1051, and the filtering chamber for introductions 1053, and four pressure adjusting chambers 1054 are also provided, respectively.

The pressure adjusting chamber 1054 has a concave shape which is open to the first flow path member 1041 side of the second flow path member 1042 which is a plate-shaped member. In addition, the pressure adjusting chamber 1054 communicates with the introduction path 1052 on the base on one end portion side in a direction orthogonal to the aligning direction, and communicates with the filtering chamber 1058 through the outflow port 1056 which is provided on the base on the other end side.

Here, the outflow path 1055 is formed inside a connection portion 1431 which is provided in a protruding manner in the concave portion on the base of the third flow path member 1043, and a connection portion 1561 is fitted into a bush 1562 which is formed of an elastic member such as rubber. The bush 1562 is held by an opening portion 1563 of the fourth flow path member 1044, and a through hole 1564 which penetrates the third flow path member 1043 communicates with the base unit of the opening portion 1563. A connection portion 1565 in which a second introduction path 1057 is formed is inserted into the through hole 1564, and a tip end portion of the connection portion 1565 is fitted into the bush 1562, and the connection portion is connected to the connection portion 1561 through the bush 1562.

The pressure adjusting chamber 1054 is sealed using a film member 1047 which is provided on an opening face of the second flow path member 1042. Here, the film member 1047 is a flexible thin film, and is fixed onto the surface of the second flow path member 1042 using heat welding, or the like. In addition, the film member 1047 is subjected to pressure forming so as to be in a bent state in a dome shape in the pressure adjusting chamber 1054.

In addition, an elastic plate 1048 which is arranged on the film member 1047 side is provided in the pressure adjusting chamber 1054 of the second flow path member 1042. The elastic plate 1048 is provided in the pressure adjusting chamber 1054 in a protruding manner in a state in which one end portion side is fixed onto the surface side of the second flow path member 1042, and a tip end thereof becomes a free end in the pressure adjusting chamber 1054. According to the embodiment, as illustrated in FIG. 2, the elastic plate 1048 is formed so as to have a so-called comb-tooth shape which is configured of a common portion 1048*a* which is shared by a plurality of the elastic plates 1048 on a fixing end side, and an elastic unit 1048*c* which is divided using a slit 1048*b* which protrudes inside the pressure adjusting chamber 1054.

The elastic plate 1048 is fixed when the common portion 1048*a* is held on the opening face side of the pressure adjusting chamber 1054. In addition, as the elastic plate 1048, a plate-shaped member which is elastic and is ink-resisting may be used, and according to the embodiment, a stainless steel plate is used.

In addition, as illustrated in FIGS. 2 to 4, a valve 1100 which opens or closes a communication state between the introduction path 1052 and the pressure adjusting chamber 1054 is provided therebetween. The valve 1100 configures the back-pressure control unit along with the pressure adjusting chamber 1054.

Specifically, the valve 1100 is provided in a cylindrical case unit 1101 which is provided in a protruding manner on the surface of the third flow path member 1043, and a top face of the case unit 1101 comes into contact with the base of the second flow path member 1042. In addition, the inside of the case unit 1101 communicates with the filtering chamber 1533 on the downstream side, and the pressure adjusting chamber 1054.

In addition, the valve 1100 which is provided in the case unit 1101 includes a columnar shaft portion 1104 which is inserted into an insertion hole 1103 which communicates with the inside of the case unit 1101 and the pressure adjusting chamber 1054, and a disk-shaped flange portion 1105 of which an outer diameter is larger than that of the shaft portion 1104, which is provided at a lower end portion of the shaft portion 1104 in the case unit 1101. A lower end of the shaft portion 1104 is connected to a center on a top face of the flange portion 1105, and a higher end of the shaft portion 1104 comes into contact with a lower face (face on pressure adjusting chamber 1054 side) of the elastic plate 1048.

The outer diameter of the flange portion 1105 is larger than the inner diameter of the insertion hole 1103, and is slightly smaller than the inner diameter of the case unit 1101. In addition, a coil spring 1106 which is an example of an urging member is installed between a lower face of the flange portion 1105 (face on third flow path member 1043 side) and a top face of the third flow path member 1043.

The coil spring 1106 is set so as to urge the valve 1100 upward which is a direction in which the valve is usually in a closed state (film member 1047 side). In addition, the closed state of the valve 1100 is a state in which the flange portion 1105 comes into close contact with the base of the second flow path member 1042, and the insertion hole 1103 is closed, that is, a non-communication state.

In addition, when a pressure in the inside of the pressure adjusting chamber 1054 becomes negative due to supplying of ink to the head main body 210, the film member 1047 is displaced so as to bend on the pressure adjusting chamber 1054 side (third flow path member 1043 side) due to a pressure difference from atmospheric pressure in the film holding unit 1060. The elastic unit 1048*c* (refer to FIG. 2) of the elastic plate 1048 is subjected to elastic deformation so as to bend toward the third flow path member 1043 side along with the displacement of the film member 1047.

When the shaft portion 1104 pushes the valve 1100 down to the third flow path member 1043 side against an urging force of the coil spring 1106, due to the elastic deformation of the elastic plate 1048, the flange portion 1105 secedes from a wall face to which the insertion hole 1103 opens, and the pressure adjusting chamber 1054 and the introduction path 1052 communicate with each other.

In this manner, when the pressure adjusting chamber 1054 and the introduction path 1052 communicate with each other, ink on the introduction path 1052 flows into the pressure adjusting chamber 1054. In addition, when liquid is sufficiently filled in the pressure adjusting chamber 1054 and the supply path 1059, the negative pressure in the pressure adjusting chamber 1054 is eliminated, the elastic plate 1048 returns to the original state, and a pressure in the inside of each of the pressure adjusting chambers 1054 is usually maintained so as to be constant when each of valves 1100 is respectively closed due to the urging force of each of the coil springs 1106.

In addition, the first flow path member 1041 which seals the pressure adjusting chamber 1054 which is provided in the second flow path member 1042 includes the concave-shaped film holding unit 1060 which is a space for allowing deformation of the film member 1047 by facing each pressure adjusting chamber 1054 on a face on the second flow path member 1042 side. In addition, the first flow path member 1041 includes a through hole 1611 which is penetrating in the thickness direction which is open into the film holding unit 1060, and opens the inside of the film holding unit 1060 to the atmosphere in the cover 1030.

Meanwhile, as illustrated in FIGS. 3A and 3B, four filtering chambers 1058 which are provided in the second main body 1040B which is configured of the fifth flow path member 1045 and the sixth flow path member 1046, and respectively include a filtering member 1581 which is interposed between the fifth flow path member 1045 and the sixth flow path member 1046, the upstream filtering chamber 1582 which is provided in the fifth flow path member 1045, and a downstream filtering chamber 1583 which is provided in the sixth flow path member 1046. Here, the fifth flow path member 1045 which demarcates the upstream filtering chamber 1582, and the sixth flow path member 1046 which demarcates the downstream filtering chamber 1583 configure a filter support member.

Figure 8A:
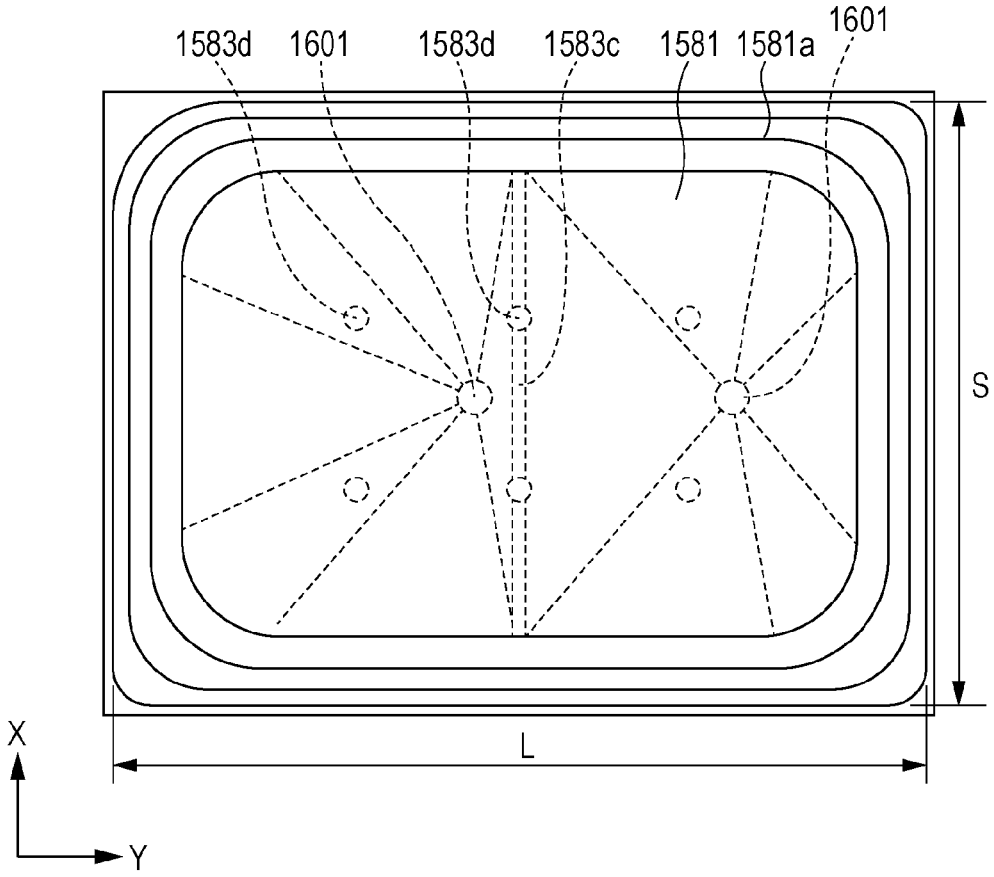
FIGS. 8A and 8B are a plan view and a cross-sectional view of a downstream filter chamber according to the first embodiment.
Figure 8B:
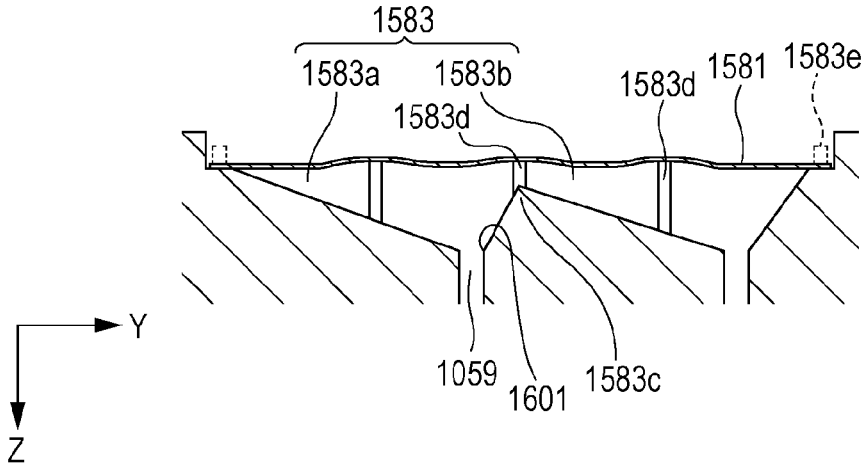

Here, FIGS. 8A and 8B illustrate a planar view and a cross-sectional view of the downstream filtering chamber 1583. As illustrated, the downstream side of the downstream filtering chamber 1583 is branched off into at least two. According to the embodiment, one downstream filtering chamber 1583 is provided with two liquid storage units 1583*a* and 1583*b* which communicate with each other by being located on the lower side of the filter member 1581, and communication holes 1601 are respectively provided at the lowest portions on the bases of each of the liquid storage units 1583*a* and 1583*b* which are inclined. Accordingly, two communication holes 1601 are provided in each of the downstream filtering chambers 1583, and eight communication holes 1601 in total are provided in four downstream filtering chambers 1583. In addition, the eight communication holes 1601 respectively communicate with eight supply paths 1059, and respectively communicate with eight planar flow paths 1313 which respectively communicate with eight supply ports 1312 which are provided on the base of the base unit 1031 through the supply path 1059 (refer to FIGS. 3A to 5B). As a matter of course, the plurality of communication holes 1601 and supply paths 1059 may be provided by respectively corresponding to the eight supply ports 1312.

In addition, when it is described in detail, the liquid storage units 1583*a* and 1583*b* of the downstream filtering chamber 1583 are open toward the upstream filtering chamber 1582, and a peripheral edge portion of the filter member 1581 is fixed to a step portion which is provided in the sixth flow path member 1046 at the periphery of the liquid storage units 1583*a* and 1583*b*. A method of fixing the filter member 1581 to the step portion is not particularly limited, and for example, there is welding such as heat welding or ultrasonic welding, bonding using an adhesive, or the like. According to the embodiment, the filter member 1581 is fixed onto a filter attaching face by providing a director 1583*e* which protrudes to the filter attaching face, melting the director 1583*e* using heat, ultrasonic waves, or the like, in a state of pressing the filter member 1581 toward the director 1583*e*, and solidifying the director 1583*e*. In addition, since the director 1583*e* spreads in a micropore of the filter member 1581 and on a face on the sixth flow path member 1046 side after being melted, in FIGS. 8A and 8B, the director 1583*e* before being melted is denoted by a dotted line.

The filter member 1581 is a member for eliminating foreign substances such as dusts or air bubbles which are contained in ink as liquid, and for example, it is possible to use a sheet-like member in which a plurality of micropores are formed by finely knitting a fiber such as a metallic fiber or a resin fiber, a plate-shaped member which is formed of metal, a resin, or the like, on which a plurality of micropores are formed, or the like. In addition, the filter member 1581 may be formed of a non-woven fabric, and a material thereof is not particularly limited.

Here, as illustrated in FIGS. 8A and 8B, the filter member 1581 has a longitudinal direction L and a transverse direction S, and forms a region which faces the liquid storage units 1583*a* and 1583*b*. Meanwhile, dimensions of both opening portions of the liquid storage units 1583*a* and 1583*b* are slightly smaller than the dimensions of the filter member 1581 in the longitudinal direction L and the transverse direction S, respective bases of the opening portions are high at the peripheral portions, and the opening portions are formed as inclined faces which are inclined so as to be low toward the communication hole 1601. In addition, a ridge 1583*c* is formed between the liquid storage units 1583*a* and 1583*b*. The ridge 1583*c* is lower than the peripheral portions of the liquid storage units 1583*a* and 1583*b*, and is elevated toward the filter member 1581 between two communication holes 1601, though the ridge does not come into contact with the filter member 1581.

On the bases of the liquid storage units 1583*a* and 1583*b*, base end portions are fixed, and a column-shaped rib 1583*d* of which a tip end is provided toward a filter 216 side, that is, in a protruding manner in a linear shape in the third direction Z is provided. According to the embodiment, two ribs 1583*d* are provided on an inclined face on the left side of the communication hole 1601 on the left side, on the ridge 1583*c*, and between the ridge 1583*c* and the communication hole 1601 on the right side, respectively, and support the filter member 1581.

As described above, liquid which is introduced from one pressure adjusting chamber 1054 enters one upstream filtering chamber 1582 through the second introduction path 1057, enters one downstream filtering chamber 1583 by being filtered using one filter member 1581, and is branched off into two supply paths 1059 through the two communication holes 1601 which are provided on the base.

In addition, according to the embodiment, liquid from four pressure adjusting chambers 1054 corresponds to any one of black Bk, magenta M, cyan C, and yellow Y, and the four communication holes 1601 are branched off into two supply paths 1059 of each color, respectively, through the downstream filtering chamber 1058.

Meanwhile, as illustrated in FIGS. 5A and 5B, eight planar flow paths 1313 are arranged in the base unit 1031, and each planar flow path 1313 communicates with a supply port 1312 which penetrates the flow path to the rear face. Here, the eight planar flow paths 1313 are formed of two planar flow paths 1313Bk corresponding to black Bk, two planar flow paths 1313M corresponding to magenta M, two planar flow paths 1313C corresponding to cyan C, and two planar flow paths 1313Y corresponding to yellow Y, and the two planar flow paths 1313Bk communicate with supply paths 1312Bk, respectively, the two planar flow paths 1313M communicate with supply paths 1312M, respectively, the two planar flow paths 1313C communicate with supply paths 1312C, respectively, and the two planar flow paths 1313Y communicate with supply paths 1312Y, respectively.

In this manner, according to the embodiment, four types of liquid which are introduced from four connection ports 1051, that is, black Bk, magenta M, cyan C, and yellow Y are introduced to four filtering chambers 1058 through four pressure adjusting chambers 1054, respectively, are branched off into two in respective downstream filtering chambers 1583, and are supplied to the head main body 210 from the eight supply ports 1312. In addition, according to the embodiment, four head main bodies 210 are provided, and each head main body 210 includes two nozzle columns, respectively, and liquid from the eight supply ports 1312 is supplied to one nozzle column.

In this manner, according to the embodiment, the downstream filtering chamber 1583 communicates with two branching flow paths 1593 and 1596, and is branched off into two. In this manner, it is possible to share two nozzle columns in one pressure adjusting chamber 1054 which supplies liquid of one type, to miniaturize the member, and to reduce cost.

In addition, by sharing one filter member 1581 in two nozzle columns, it is also possible to miniaturize the member, and to reduce costs due to this.

Figure 9A:
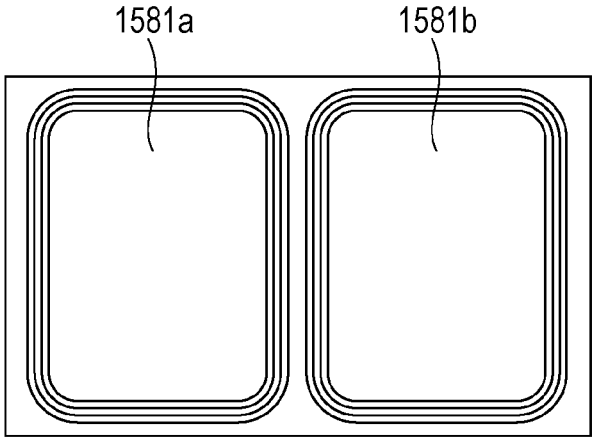
FIGS. 9A and 9B are diagrams which describe an effect of the invention.
Figure 9B:
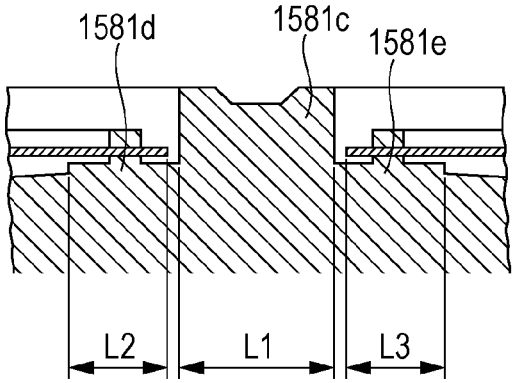

When comparing a case in which one filter member 1581 is provided with respect to two flow paths, as illustrated in FIGS. 8A and 8B, with a case in which the filter members 1581*a* and 1581*b* are provided in each flow path, as illustrated in FIGS. 9A and 9B, in a case in which the filter members 1581*a* and 1581*b* are provided, a partitioning wall 1581*c* is present between both, and welding portions 1581*d* and 1581*e* are present on both sides of the partitioning wall 1581*c*. Accordingly, when one filter member 1581 is used, it is possible to reduce a space by a total dimension which is obtained by totaling a dimension L1 of the partitioning wall 1581*c*, and dimensions L2 and L3 of the welding portions 1581*d* and 1581*e*.

Figure 10A:
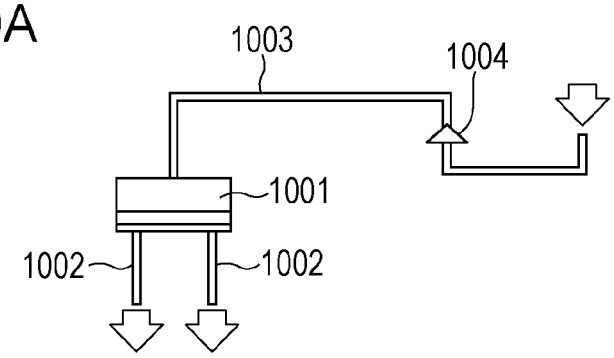
FIGS. 10A to 10C are diagrams which describe modification examples of the invention.
Figure 10B:
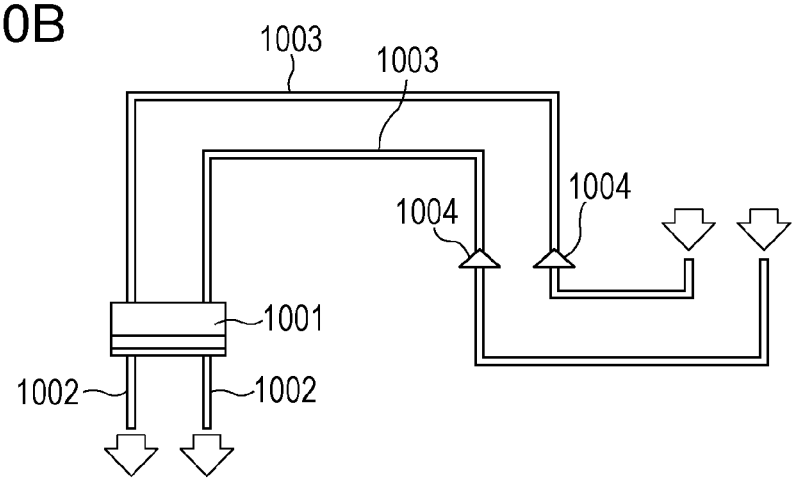
Figure 10C:
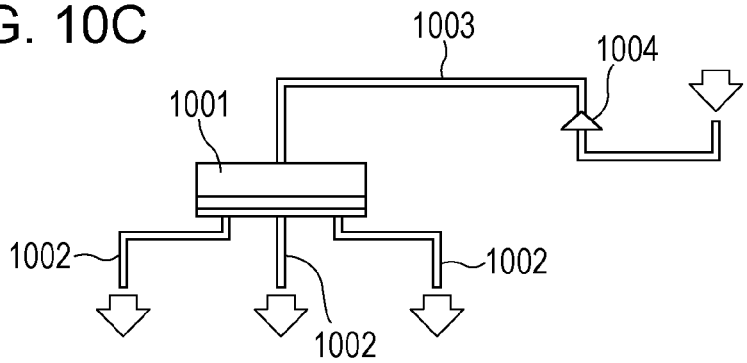

According to the embodiment, as illustrated in FIG. 10A, it is set such that two branching flow paths 1002 communicate with one filtering chamber 1001 on the downstream side, one upstream flow path 1003 is provided, and a back-pressure control unit 1004 is installed here; however, when two or more branching flow paths 1002 are provided on the downstream side of the filtering chamber 1001, it is not limited to this. For example, as illustrated in FIG. 10B, it may be a configuration in which two upstream flow paths 1003 are provided, and the back-pressure control unit 1004 is installed, respectively, and may be a configuration in which three branching flow paths 1002 communicate with the filtering chamber 1001 on the downstream side, as illustrated in FIG. 10C.

In addition, atmosphere opening path 1062 which opens atmosphere in the cover 1030 to atmosphere is provided in the back-pressure control unit 1020.

Figure 11A:
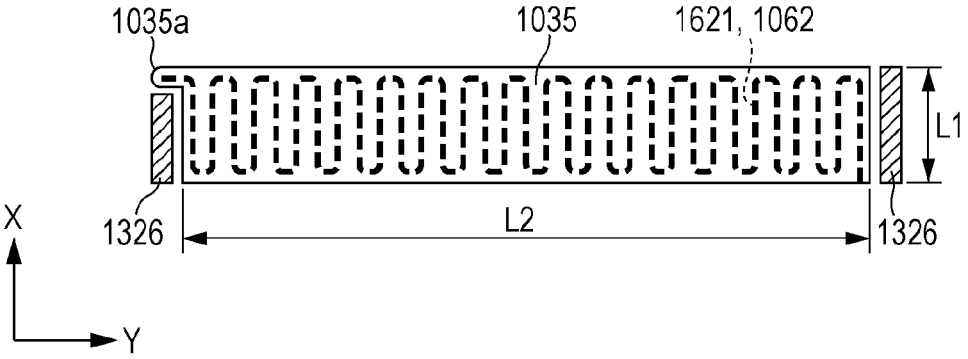
FIGS. 11A to 11C are diagrams which schematically illustrate positional relationship in abutting units according to the first embodiment and modification examples.
Figure 11B:
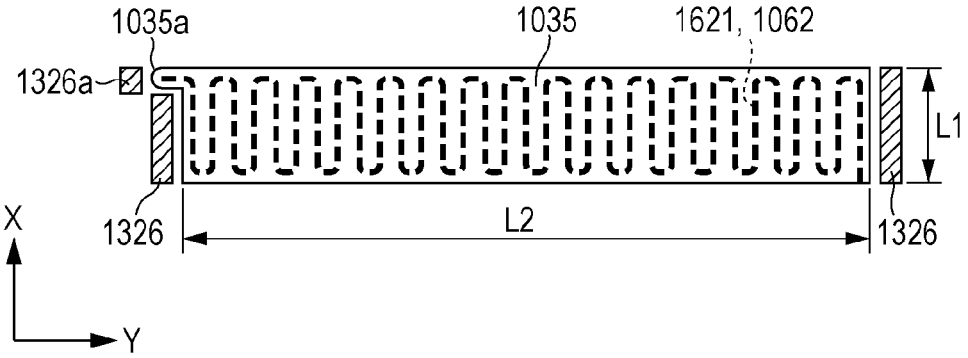
Figure 11C:
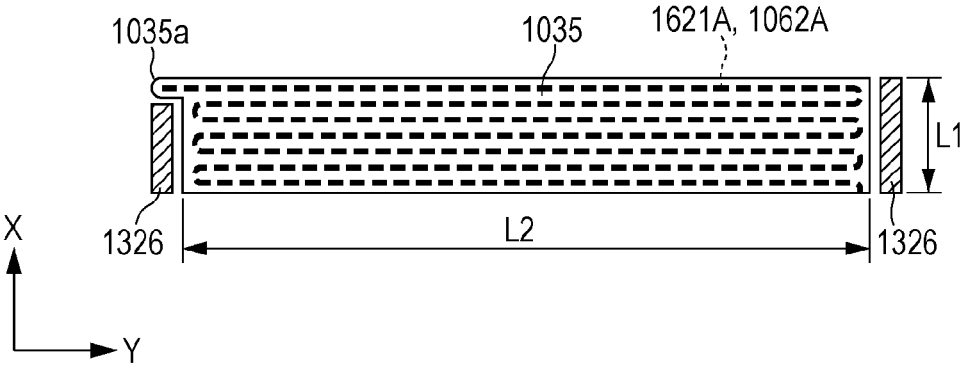
Figure 12:
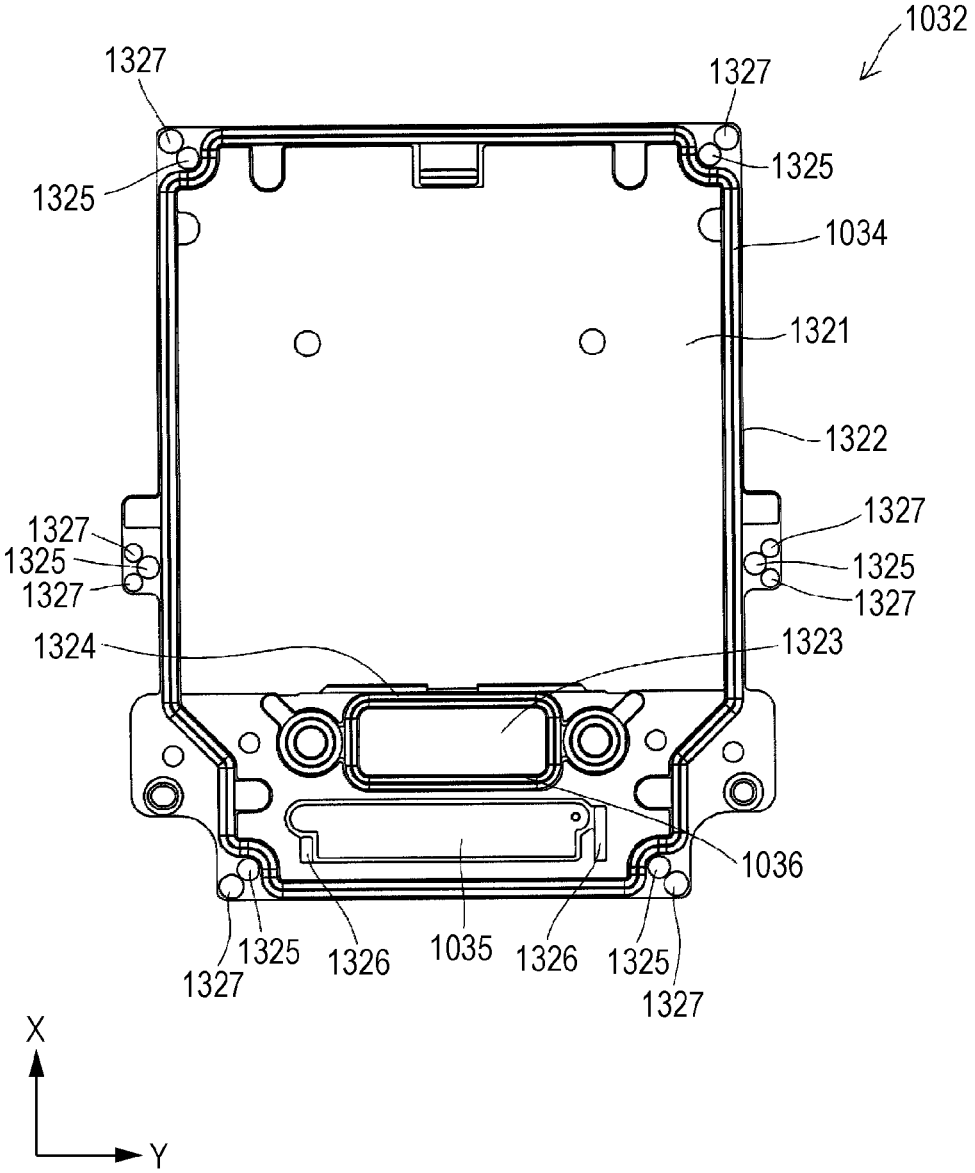
FIG. 12 is an enlarged view of FIG. 6B.
Figure 13A:
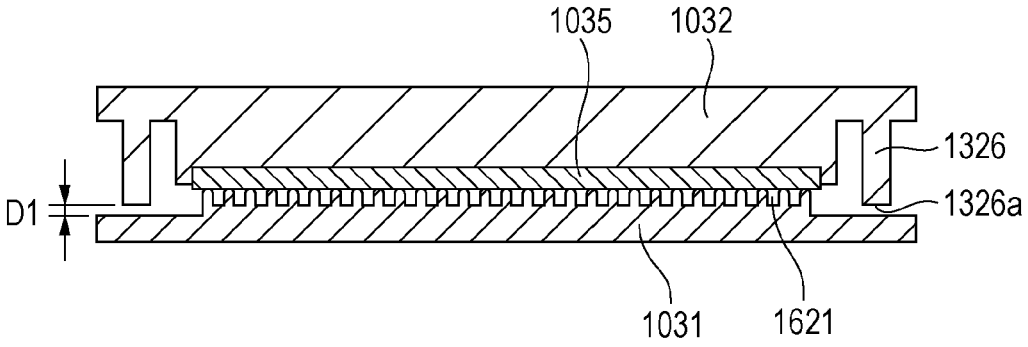
FIGS. 13A and 13B are diagrams which describe a crushing amount of a sealing unit.
Figure 13B:
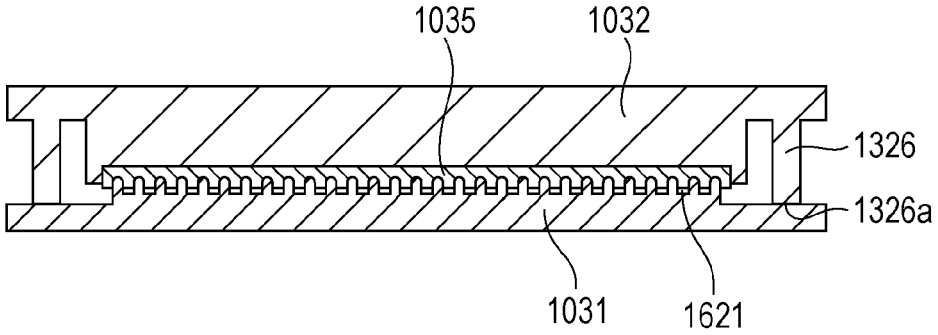
Figure 14:
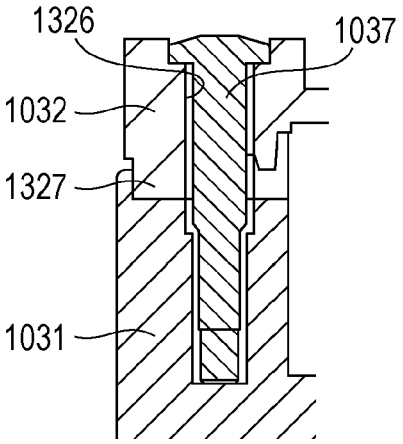
FIG. 14 is a cross-sectional view in the vicinity of a second abutting unit.

Here, the atmosphere opening path 1062 will be described in detail with reference to FIGS. 3A, 3B, 6A, 6B, 7, and 11A to 14. In addition, FIGS. 11A to 11C are diagrams which schematically illustrate a positional relationship between abutting units in the first embodiment and a modification example, FIG. 12 is an enlarged view of FIG. 6B, FIGS. 13A and 13B are diagrams which describe a crushing amount of a sealing unit, and FIG. 14 is a cross-sectional view in the vicinity of the second abutting unit.

The atmosphere opening path 1062 is configured of a meandering path 1621 which is formed of meandering grooves which are provided on a face facing the cover unit 1032 of the base unit 1031.

In the meandering path 1621, one end portion 1621*a* communicates with atmosphere in the cover 1030, the other end portion 1621*b* communicates with the outside, and the meandering path is formed of grooves which have concave shapes meandering toward the second direction Y while reciprocating in the first direction X. A narrow communication path for communication with the outside is formed by sealing the meandering path 1621 using a sealing member.

In this manner, it is possible to deform the film member 1047 using a pressure difference between a pressure in the pressure adjusting chamber 1054 and an atmospheric pressure, by opening the film holding unit 1060 on the side opposite to the pressure adjusting chamber 1054 of the film member 1047 to atmosphere using the atmosphere opening path 1062.

In addition, by configuring the atmosphere opening path 1062 using the meandering path 1621, it is possible to form the atmosphere opening path 1062 long with a small cross-sectional area. In this manner, it is possible to suppress moisture evaporation from the film member 1047 by providing diffusion resistance to the atmosphere opening path 1062. Incidentally, since moisture of ink which is poured into the pressure adjusting chamber 1054 penetrates the film member 1047, when the atmosphere opening path to which diffusive resistance is not given is provided, moisture which has penetrated the film member 1047 is easily evaporated, and there is a problem in that viscosity of ink increases, or the like. According to the embodiment, since evaporation of moisture of ink which penetrates the film member 1047 is suppressed, it is possible to suppress the problem in which viscosity of ink increases, or the like.

Here, as illustrated in FIG. 12, in the cover unit 1032, a first sealing unit 1034, a second sealing unit 1035, and a third sealing unit 1036 which are formed of rubber, elastoma, or the like, are provided in a state of being separated from each other.

As described above, the first sealing unit 1034 is provided over a tip end face of a second wall portion 1322 of the cover unit 1032, and suppresses outflow of ink in the holding unit 1033 of the cover 1030 to the outside by sealing a joint at the outer periphery of the base unit 1031 and the cover unit 1032 using the first sealing unit 1034.

The second sealing unit 1035 is provided at a position facing the meandering path 1621 of the cover unit 1032 (refer to FIGS. 3A and 3B), and seals an opening of the meandering path 1621 on the cover unit 1032 side.

The third sealing unit 1036 is provided over the periphery of the opening portion 1323 on a face of a protrusion portion 1324 on the first flow path member 1041 side, in which the above described opening portion 1323 is provided. The third sealing unit 1036 seals a gap between the connection port 1051 of the main body of the flow path member 1040 and the cover unit 1032 at the periphery of the connection port. When the third sealing unit 1036 is fixed to the opening portion 1323, it is possible to prevent ink which is leaked when attaching or detaching a supply tube which is connected to the connection port 1051, or the like, from flowing into the holding unit 1033, and to prevent ink in the holding unit 1033 from leaking from an interval with the cover unit 1032 at the periphery of the connection port 1051.

The first sealing unit 1034, the second sealing unit 1035, and the third sealing unit 1036 are provided in the cover unit 1032 at positions of which height is different, respectively. Specifically, the first sealing unit 1034 is provided on a tip end face of the second wall portion 1322 of the cover unit 1032, as described above. In addition, the second sealing unit 1035 is provided on a face facing the base portion 1031 of the cover unit 1032. In addition, the third sealing unit 1036 is provided on a tip end face of a protrusion portion 1324 which protrudes so as to be lower than the second wall portion 1322 of the cover unit 1032.

In addition, the first sealing unit 1034, the second sealing unit 1035, and the third sealing unit 1036 are integrally formed using a two-color molding method along with the cover unit 1032. According to the embodiment, both are integrally formed by molding a rubber material at a predetermined position of the cover unit 1032 after forming the cover unit 1032 by molding a resin material.

In this manner, it is not necessary to perform positioning of the first sealing unit 1034, the second sealing unit 1035, and the third sealing unit 1036 by integrally forming the cover unit 1032, and the first sealing unit 1034, the second sealing unit 1035, and the third sealing unit 1036 using the two-color molding method, and it is possible to reduce costs by simplifying an assembling operation of the back-pressure control unit 1020. In particular, as in the embodiment, it is possible to simplify the assembling operation, since it is not necessary to perform the positioning operation when providing the first sealing unit 1034, the second sealing unit 1035, and the third sealing unit 1036 in the cover unit 1032 at positions of which height is different, and to suppress leaking of ink due to position shifts of the first sealing unit 1034, the second sealing unit 1035, and the third sealing unit 1036.

In addition, by integrally forming the cover unit 1032, and the first sealing unit 1034, the second sealing unit 1035, and the third sealing unit 1036 using the two-color molding method, it is possible to reduce the number of components, and manufacturing costs and assembling costs, compared to a case in which a separate plate-shaped sealing member is used.

In addition, as illustrated in FIGS. 1 to 7, the base unit 1031 and the cover unit 1032 are fixed in a state of being integrated by screwing a tip end of the fastening member 1037 (refer to FIG. 1) such as a screw which is inserted into a through hole for fastening 1325 of the cover unit 1032 to a fixing hole 1316.

Here, in the invention, since it is controlled so that there is no unevenness in crushing amount of the first sealing unit 1034, the second sealing unit 1035, and the third sealing unit 1036, by controlling a fastening amount of the fastening member 1037, the crushing amount of the first sealing unit 1034, the second sealing unit 1035, and the third sealing unit 1036 are set so as to be uniform, by precisely controlling the height of the abutting unit by providing the abutting unit on any one side of facing faces of the base unit 1031 and the cover unit 1032 by facing each other.

First, in order to reduce unevenness of the crushing amount of the second sealing unit 1035 which covers the meandering path 1621 which configures the atmosphere opening path 1062, as schematically illustrated in FIG. 11A, a first abutting unit 1326 is provided on both sides of the meandering path 1621 in the second direction Y, which is formed of grooves (corresponding to flow path groove in invention) which have concave shapes meandering toward the second direction Y while reciprocating in the first direction X. In practice, as illustrated in FIG. 12, the first abutting unit 1326 extends along the first direction X on both sides of the second sealing unit 1035 of the cover unit 1032 in the second direction Y. The length of the first abutting unit 1326 in the extending direction is the same as the dimension L1 of the meandering path 1621 in the first direction X. However, the length of the first abutting unit 1326 on the left side in FIGS. 11A to 11C is smaller than the extended dimension L1 of the meandering path 1621 in the first direction X by being interfered with an ear portion 1035*a* of the second sealing unit 1035, but the interfered portion is also included similarly to the dimension L1 in the first direction X of the meandering path 1621. In addition, in this case, as illustrated in FIG. 11B, a first abutting unit 1326*a* may be provided on the outer side of the ear portion 1035*a* of the second sealing unit 1035. In addition, the first abutting unit may be extended by the dimension L1 at a position of the first abutting unit 1326*a* on the outer side of the ear portion 1035*a* in the first direction X; however, it is effective to provide the first abutting unit at a position which is close to the meandering path 1621 as much as possible.

In this manner, the first abutting unit 1326 may be provided on four sides of a region in which the meandering path 1621 is provided; however, the first abutting unit may be provided on both sides in any one of the extending direction and the aligning direction. It is not effective when the abutting unit is provided so as to be long, and conversely, there also is a possibility of increasing unevenness since it is difficult to precisely manage the height. In addition, for the same reason, when the abutting unit is provided on both sides in any one of the extending direction and the aligning direction, it is preferable to provide the abutting unit on a side of which a dimension is small. The reason for this is that it is preferable to manage the height, and there is no difference in effects. In addition, according to the embodiment, since the dimension L1 in the first direction X which is the extending direction is smaller than the dimension L2 of the second direction Y which is the aligning direction, the first abutting unit 1326 is provided on both sides in the second direction Y.

Meanwhile, since the first abutting unit 1326 is extended by a predetermined length compared to the cylindrical abutting unit, it is effective to precisely manage the crushing amount of the second sealing unit 1035, and since the first abutting unit is provided so as to be closed to a region in which the meandering path 1621 is provided, it is understood that the effect is further improved.

In addition, according to the embodiment, the first abutting unit 1326 is provided on both sides in the second direction Y, since the dimension L1 in the first direction X which is the extending direction is smaller than the dimension L2 in the second direction Y which is the aligning direction; however, as illustrated in FIG. 11C, when the dimension L1 in the first direction X which is the aligning direction is smaller than the dimension L2 in the second direction Y which is the extending direction, the first abutting unit 1326 is provided on both sides in the extending direction, that is, on both sides in the second direction Y.

When the first abutting unit 1326 is provided, as illustrated in FIGS. 13A and 13B, it is possible to precisely manage the crushing amount of the second sealing unit 1035, and to perform uniform crushing in the whole unit. That is, as illustrated in FIG. 13A, the end face of the first abutting unit 1326 and a facing face are separated by D1 in a state in which the surface of the second sealing unit 1035 comes into contact with wall faces on both sides of the groove of the meandering path 1621; however, as illustrated in FIG. 13B, when the end face of the first abutting unit 1326 comes into contact with the facing face, it becomes a crushing amount of the second sealing unit 1035, the crushing amount in this case becomes D1. Accordingly, by controlling the height of the first abutting unit 1326, it is possible to precisely control the crushing amount D1. In this manner, it is possible to prevent exudation of oil from the second sealing unit 1035 due to excessive crushing, or choking of the meandering path 1621, or the like, due to the exudation of oil.

In addition, according to the embodiment, a second abutting unit 1327 is provided in the vicinity of the fastening member, in order to reduce unevenness by further precisely controlling the crushing amount of the second sealing unit 1035. That is, as illustrated in FIG. 12, the second abutting unit 1327 which is a cylindrical protrusion portion is provided in the vicinity of a through hole for fastening 1325 through which the fastening member of the cover unit 1032 passes. In addition, two second abutting units 1327 are provided in the vicinity of a through hole for fastening 1325 on both sides of a center portion in the first direction X.

The second abutting unit 1327 is a unit for assisting the first abutting unit 1326, it is effective when being a columnar protrusion portion. In addition, by providing the second abutting unit in the vicinity of the fastening member, it is possible to more precisely manage the crushing amount.

A cross section in the vicinity of the fastening member in a fastened state is illustrated in FIG. 14. As illustrated, a fastening amount of the fastening member 1037 is regulated when the end face of the second abutting unit 1327 comes into contact with a facing face, and the crushing amount of the second sealing unit 1035 is more precisely managed. In this manner, it is possible to prevent exudation of oil from the second sealing unit 1035 due to excessive crushing, or choking of the meandering path 1621, or the like, due to the exudation of oil.

Here, the second abutting unit 1327 is set to a cylindrical protrusion portion; however, by providing the second abutting unit so as to be close to the fastening member 1037, it is possible to exert the effect of the abutting unit. In addition, the second abutting unit 1327 may be formed as a ring-shaped abutting unit so as to surround the fastening member 1037; however, it is more preferable to form the abutting unit so as to be the cylindrical protrusion portion in order to precisely manage the height.

In addition, in the above descriptions, a point of controlling the crushing amount of the second sealing unit 1035 has been described; however, as a matter of course, similarly, also the crushing amount of the first sealing unit 1034 and the third sealing unit 1036 are precisely managed. In addition, according to the embodiment, the first abutting unit 1326 and the second abutting unit 1327 are provided in the cover unit 1032; however, the abutting units may be provided in the base unit 1031, and it is needless to say that the same effect is exerted.

As illustrated in FIG. 1, the head case 1080 which holds a circuit board between the head case and the base unit 1031, and the head main body 210 which is provided on the base of the head case 1080 are provided on the base of the base unit 1031 of the back-pressure control unit 1020.

The head case 1080 is fixed to the base of the base unit 1031, and holds the circuit board (not illustrated) between the head case and the base unit 1031.

In the head main body 210, though one example will be described later, two or more columns in which nozzle openings are aligned are provided, and are provided so as to eject ink of various types which is supplied from each back-pressure control unit 1020 from each nozzle column. According to the embodiment, though it is not particularly illustrated, it is set such that four head main bodies 210 are provided, ink of two colors are ejected from three head main bodies 210, and ink of one color is ejected from two nozzle columns from one head main body 210. In this manner, it is possible to eject ink of four colors. In addition, the number of head main bodies 210 or the arrangement is not particularly limited, and for example, the same number of head main bodies 210 as the support path 1059 may be provided.

In addition, a pressure generation chamber which communicates with nozzle openings, and a pressure generation unit which causes a pressure change in the pressure generation chamber are provided in the head main body 210. As the pressure generation unit, for example, it is possible to use a unit which ejects ink droplets from a nozzle opening by causing a pressure change by changing a volume of the pressure generation chamber using deformation of a piezoelectric actuator which includes a piezoelectric material which exhibits a function of electrical-mechanical conversion, a unit which ejects ink droplets from a nozzle opening using bubbles which are generated due to heat generating of a heat generation element, by arranging the heat generation element in the pressure generation chamber, a so-called electrostatic actuator which ejects ink droplets from a nozzle opening by deforming a vibrating plate using an electrostatic force, by generating static electricity between the vibrating plate and an electrode, or the like.

Figure 15:
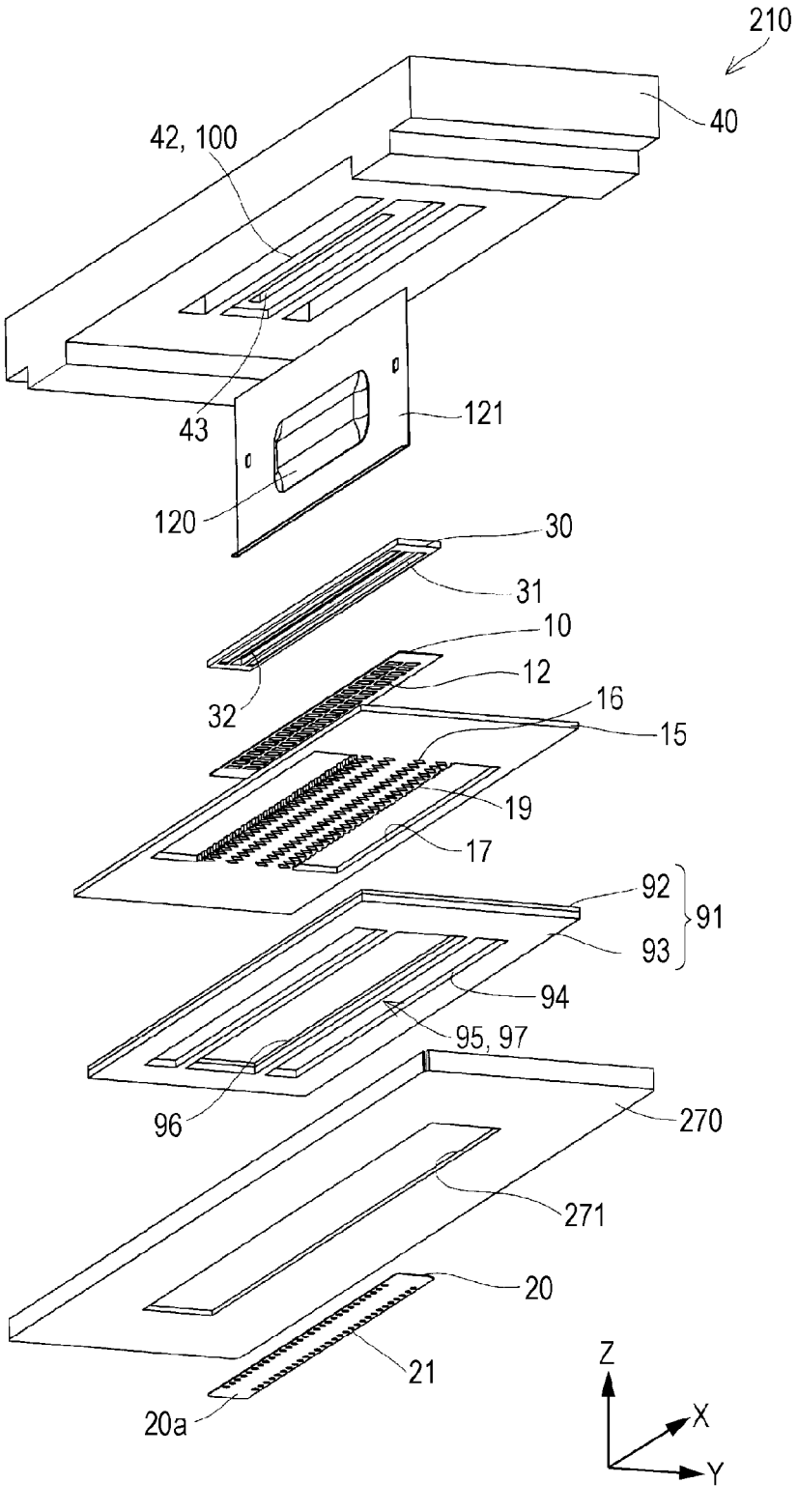
FIG. 15 is an exploded perspective view which illustrates an example of a head main body according to the first embodiment.
Figure 16:
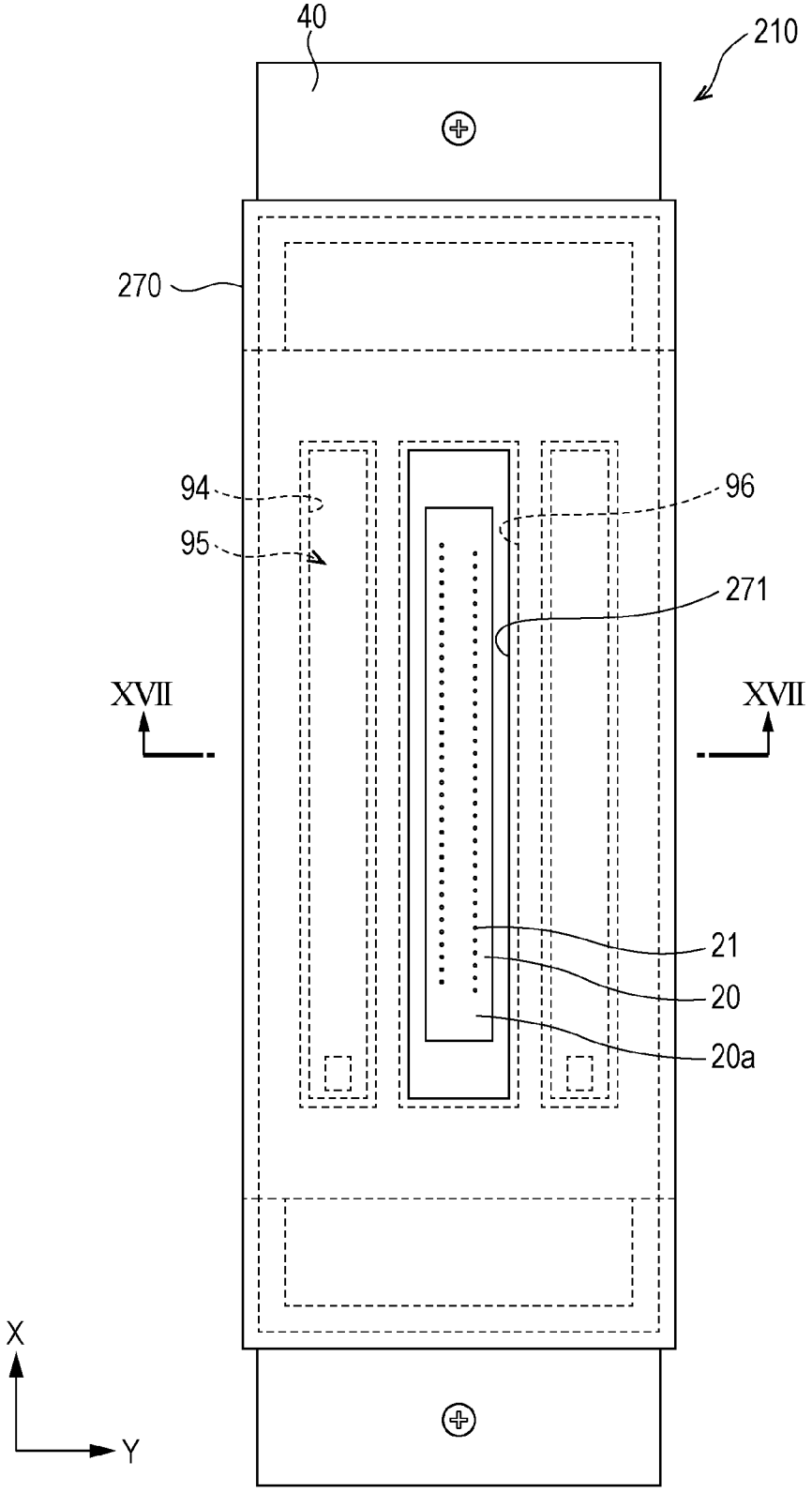
FIG. 16 is a plan view which is viewed from a liquid ejecting face side of the head main body according to the first embodiment.
Figure 17:
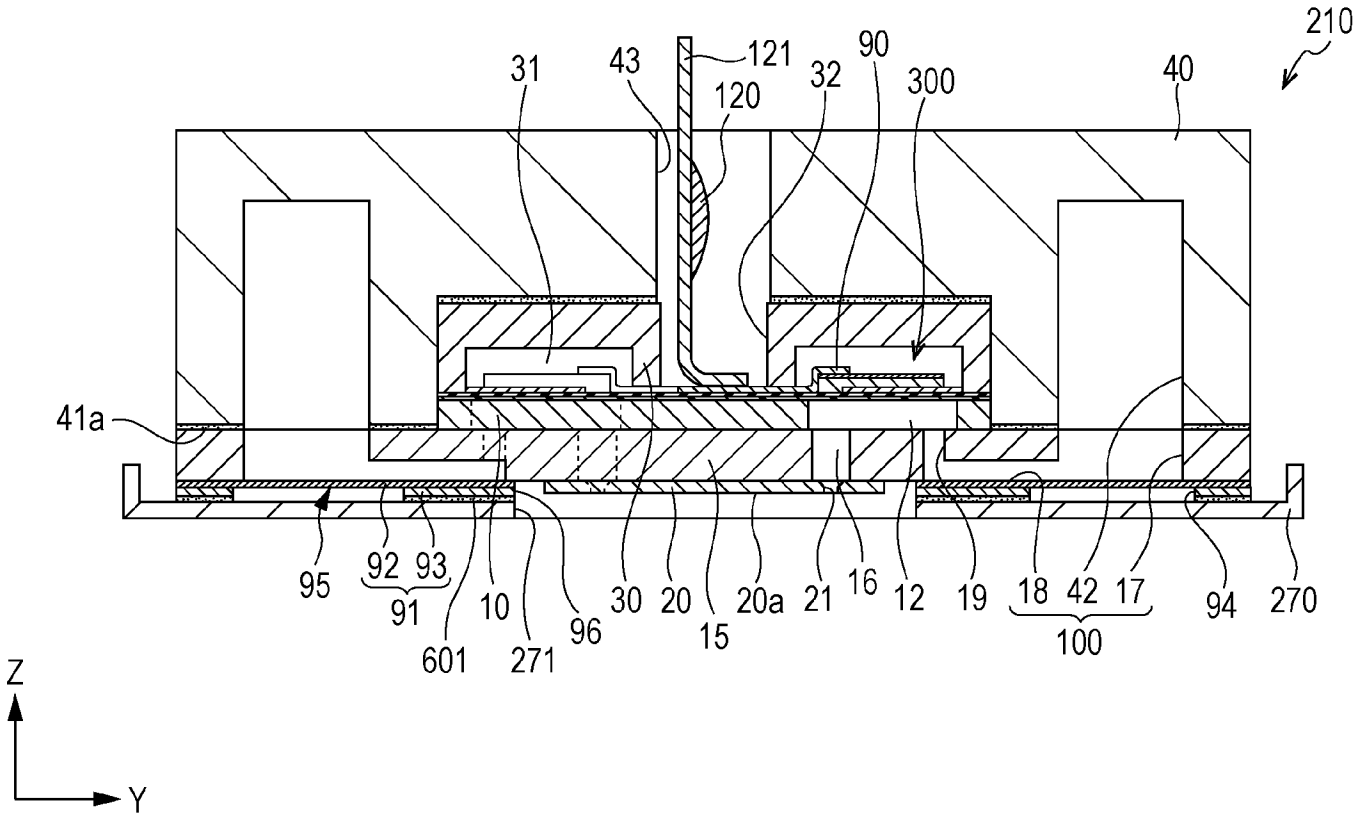
FIG. 17 is a cross-sectional view which is taken along line XVII-XVII in FIG. 16.

Here, an example of the head main body 210 will be described with reference to FIGS. 15 to 17. In addition, FIG. 15 is an exploded perspective view of the head main body, FIG. 16 is a plan view which is viewed from a liquid ejecting face side of the head main body, and FIG. 17 is a cross-sectional view which is taken along line XVII-XVII in FIG. 16.

As illustrated, the head main body 210 includes a plurality of members such as a flow path forming substrate 10, a communication plate 15, a nozzle plate 20, a protection board 30, a case member 40 which is a holding member, a compliance board 91, and these plurality of members are bonded using an adhesive, or the like.

In the flow path forming substrate 10 which configures the head main body 210, a plurality of pressure generation chambers 12 are aligned along a direction in which a plurality of nozzle openings 21 are aligned. This direction is also referred to as an aligning direction of the pressure generation chamber 12, and matches the first direction X. In this manner, also in the nozzle opening 21 which will be described in detail later, two columns of the nozzle opening 21 are arranged by being shifted in the first direction X by an interval of a half, and resolution in the first direction X becomes twice. In addition, according to the embodiment, a plurality of columns, for example, two columns in which the pressure generation chambers 12 are aligned in the first direction X are provided on the flow path forming substrate 10. The column aligning direction in which the plurality of columns of the pressure generation chamber 12 in which the pressure generation chambers 12 are aligned in the first direction X matches the second direction Y. In addition, in two columns in which the pressure generation chambers 12 are aligned in the first direction X, with respect to one column of the pressure generation chamber 12, the other column of the pressure generation chamber 12 is arranged at a position which is shifted in the first direction X by a half of a gap between pressure generation chambers 12 which are neighboring in the first direction X. As a matter of course, ink of a different color may be supplied in each column of the pressure generation chamber 12 by setting the positions of two columns of the pressure generation chamber 12 in the first direction X to be the same. In addition, according to the embodiment, as described above, the direction which is orthogonal to the first direction X and the second direction Y is referred to as the third direction Z, and a liquid ejecting direction in a plane including the third direction Z (recording sheet S side which is a medium for ejecting which will be described later) is set to a Z1 side, and the opposite side is set to a Z2 side.

The communication plate 15 is bonded onto one face of the flow path forming substrate 10 in the third direction Z, that is, a face on the Z1 side. In addition, the nozzle plate 20 in which the nozzle opening 21 is provided is bonded further on the Z1 side in the third direction Z of the communication plate 15. According to the embodiment, the Z1 side in the third direction Z to which the nozzle opening 21 of the nozzle plate 20 opens becomes a liquid ejecting face 20*a*.

The nozzle communication path 16 which communicates with the pressure generation chamber 12 and the nozzle opening 21 is provided in the communication plate 15. The communication plate 15 has a larger area than that of the flow path forming substrate 10, and the nozzle plate 20 has a smaller area than that of the flow path forming substrate 10. In this manner, it is possible to reduce costs by making the area of the nozzle plate 20 comparatively small. The area referred to here is an area in an in-plane direction which has the first direction X and the second direction Y.

In addition, a first manifold unit 17 and a second manifold unit 18 which configure a part of a manifold 100 are provided on the communication plate 15.

The first manifold unit 17 is provided so as to penetrate the communication plate 15 in the third direction Z. In addition, the second manifold unit 18 is provided halfway in the third direction Z by opening to the nozzle plate 20 side of the communication plate 15, that is, to the Z1 side, without penetrating the communication plate 15 in the third direction Z.

In addition, on the communication plate 15, a supply communication path 19 which communicates with one end portion of the pressure generation chamber 12 in the second direction Y is independently provided in each pressure generation chamber 12. The supply communication path 19 penetrates the communication plate 15 in the third direction Z, and communicates with the second manifold unit 18 and the pressure generation chamber 12.

Meanwhile, a vibrating plate is formed on an opposite face side to the communication plate 15 of the flow path forming substrate 10, that is, on the Z2 side. In addition, the piezoelectric actuator 300 which is the pressure generation unit of the embodiment is configured when a first electrode, a piezoelectric layer, and a second electrode are sequentially stacked on the vibrating plate. In general, the piezoelectric actuator 300 is configured by setting any one of electrodes to a common electrode, and by patterning other electrodes and the piezoelectric layer in each pressure generation chamber 12.

In addition, the protection board 30 with approximately the same size as the flow path forming substrate 10 is bonded to the piezoelectric actuator 300 side of the flow path forming substrate 10, that is, a face on the Z2 side. The protection board 30 has a holding unit 31 which is a space for protecting the piezoelectric actuator 300. Two holding units 31 are formed in line in the second direction Y in each piezoelectric actuator 300 which are aligned in the first direction X. In addition, in the protection board 30, a first connection hole 32 which penetrates the two holding units 31 in the third direction Z, which are aligned in the second direction Y therebetween is provided on the protection board 30. An end portion of lead electrode 90 which is led out from an electrode of the piezoelectric actuator 300 is extended in the first connection hole 32 so as to be exposed, and the lead electrode 90 and a wiring substrate 121 on which a driving circuit 120 such as a driving IC is mounted are electrically connected in the first connection hole 32. According to the embodiment, the flow path forming substrate 10, the communication plate 15, and the protection board 30 correspond to the flow path member. As a matter of course, the flow path member is not particularly limited to these, as the flow path member, the flow path forming substrate 10 may be formed in a size corresponding to the communication plate 15 without providing the communication plate 15, and as the flow path member, another member may be further provided.

In addition, as illustrated in FIG. 15, the case member 40 which demarcates the manifold 100 which communicates with the plurality of pressure generation chambers 12 along with the flow path forming substrate 10 and the protection board 30 is fixed to the protection board 30 and the communication plate 15. The case member 40 is boned to the protection board 30, and is bonded to the communication plate 15.

In addition, a third manifold unit 42 which has a concave shape opening to the face on the Z1 side is formed on the face on the Z1 side of the case member 40. In addition, the manifold 100 according to the embodiment is configured of the third manifold unit 42 which is formed in the case member 40, and the first manifold unit 17 and the second manifold unit 18 which are provided on the communication plate 15. In addition, according to the embodiment, the manifolds 100 are formed on both sides of the flow path forming substrate 10 by interposing the flow path forming substrate in the second direction Y. As a matter of course, the manifold 100 is not particularly limited to this, and for example, the manifold may be configured only of the third manifold unit 42, and may be configured of the second manifold unit 18 and the third manifold unit 42. However, by configuring the manifold 100 using the first manifold unit 17, the second manifold unit 18, and the third manifold unit 42 as in the embodiment, it is possible to form the manifold 100 in a large volume as much as possible, without making the ink jet recording head large.

In addition, a second connection hole 43 which penetrates the case member 40 in the third direction Z by communicating with the first connection hole 32 of the protection board 30 is provided in the case member 40. The wiring substrate 121 which is inserted into the second connection hole 43 is inserted into the first connection hole 32, and is connected to the lead electrode 90 which is lead-out wiring which is led out from the piezoelectric actuator 300.

In addition, the compliance board 91 is provided on a face to which the first manifold unit 17 and the second manifold unit 18 of the communication plate 15 open. The compliance board 91 seals the openings of the first manifold unit 17 and the second manifold unit 18. That is, the flow path of the flow path member which is configured of the flow path forming substrate 10, the communication plate 15, and the protection board 30 according to the embodiment is the first manifold unit 17 and the second manifold unit 18, and the compliance board 91 seals the Z1 side which is the liquid ejecting face 20*a* side of the first manifold unit 17 and the second manifold unit 18.

According to the embodiment, the compliance board 91 includes a sealing film 92 and a fixing substrate 93. The sealing film 92 is formed of a flexible thin film (for example, polyphenelene sulfide (PPS) or stainless steel (SUS)), or the like. In addition, the fixing substrate 93 is formed of a hard material such as metal such as stainless steel (SUS). Since a region of the fixing substrate 93 facing the manifold 100 becomes an opening portion 94 which is completely eliminated in the thickness direction, one face of the manifold 100 becomes a compliance unit 95 which is a flexible portion which is sealed using only the sealing film 92 which is flexible.

In addition, the compliance board 91 is continuously provided over the periphery of the nozzle plate 20. That is, the compliance board 91 is provided with a first exposure opening portion 96 with an inner diameter which is slightly larger than the nozzle plate 20 in a region in which the nozzle plate 20 is arranged.

A cover head 270 which protects the nozzle opening 21 in an exposed state is fixed on the liquid ejecting face 20*a* side to which the nozzle opening 21 of the head main body 210 opens. In addition, the cover head 270 is bonded to the fixing substrate 93 of the compliance board 91, and the case member 40.

A second exposure opening portion 271 of the cover head 270 is formed with an opening area of approximately the same size as the first exposure opening portion 96 of the compliance board 91, and exposes the liquid ejecting face 20*a* of the nozzle plate 20.

Other Embodiments

Hitherto, each embodiment of the invention has been described; however, the basic configuration of the invention is not limited to the above described configuration.

The main body of the flow path member is configured of the first main body and the second main body, and the first main body is accommodated in the cover 1030 by stacking in advance; however, it may be a structure in which the entire main body of the flow path member is stacked in advance, is accommodate in the cover, and is interposed between the base unit and the cover unit.

Figure 18:
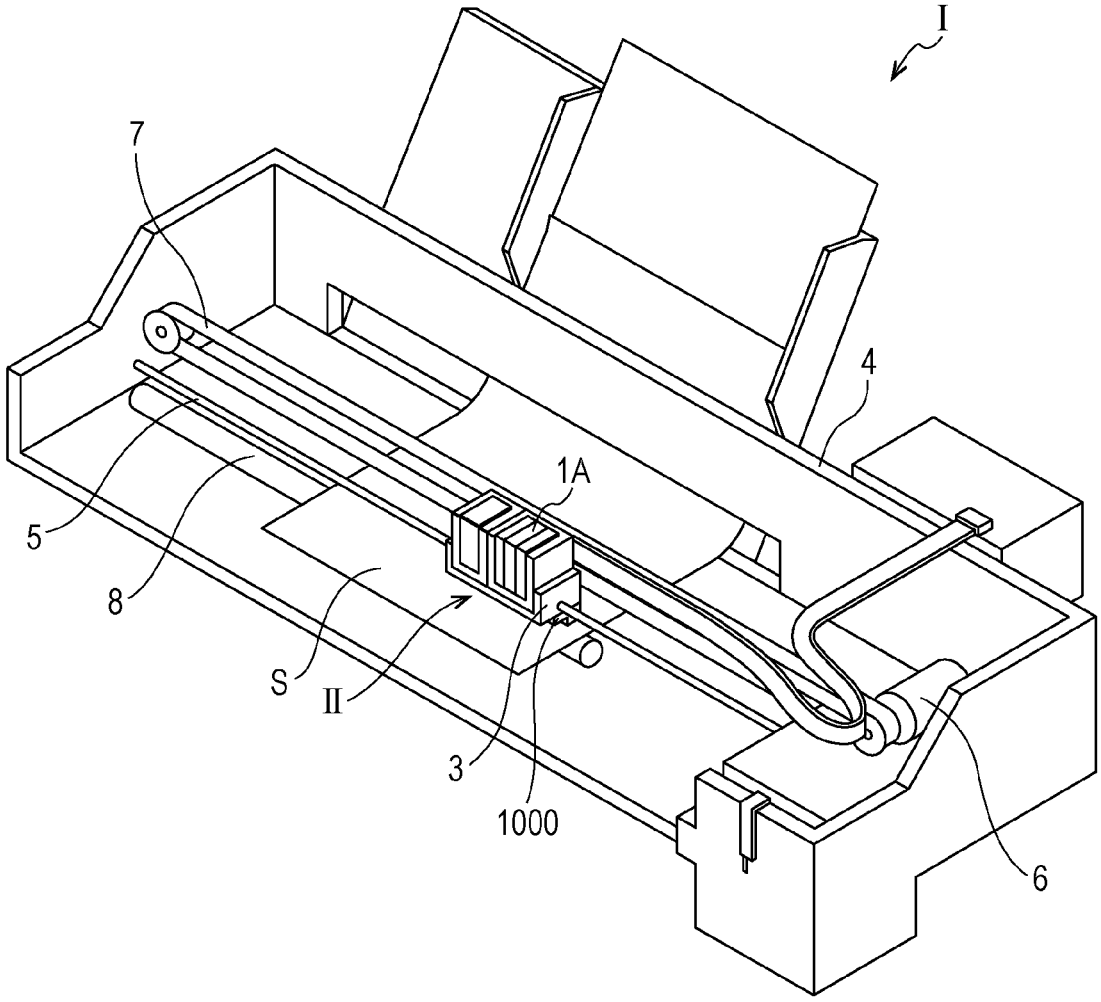
FIG. 18 is a schematic view which illustrates a liquid ejecting apparatus according to the embodiment of the invention.

In addition, the above described ink jet recording head 1000 configures a part of an ink jet recording head unit which includes an ink flow path which communicates with an ink cartridge, or the like, and is installed in an ink jet recording apparatus. FIG. 18 is a schematic diagram which illustrates an example of the ink jet recording apparatus.

In the ink jet recording apparatus I which is illustrated in FIG. 18, an ink jet recording head unit II (hereinafter, also referred to as head unit II) which includes a plurality of the ink jet recording heads 1000 is provided with a detachable ink cartridge 1A which is a liquid storage unit, and the carriage 3 in which the head unit II is installed is provided in the carriage axis 5 which is attached to the apparatus main body 4 so as to freely move in the axial direction. The recording head unit II is a unit which ejects a black ink composition and a color ink composition, for example.

In addition, the carriage 3 in which the head unit II is installed is moved along the carriage axis 5 when a driving force of the driving motor 6 is transmitted to the carriage 3 through a plurality of gears and a timing belt 7 which are not illustrated. Meanwhile, the apparatus main body 4 is provided with a transport roller 8 as a transport unit, and a recording sheet S as a recording medium such as paper, or the like, is transported using the transport roller 8. In addition, the transport unit which transports the recording sheet S is not limited to the transport roller, and may be a belt, a drum, or the like.

In addition, in the above described ink jet recording apparatus I, the ink jet recording head 1 (head unit II) is installed in the carriage 3, and moves in the main scanning direction; however, it is not particularly limited to this, and for example, it is also possible to apply the invention to a so-called line-type recording apparatus in which the ink jet recording head 1 is fixed, and printing is performed only by moving a recording sheet S such as paper in the sub-scanning direction.

In addition, in the above described embodiment, the invention has been described by exemplifying the ink jet recording head as an example of the liquid ejecting head; however, the invention is for an overall liquid ejecting apparatus, and as the liquid ejecting head, for example, there are a coloring material ejecting head which is used when manufacturing a color filter such as a liquid crystal display, an organic EL display, an electrode material ejecting head which is used when forming an electrode such as a field emission display (FED), a bio-organic material ejecting head which is used when manufacturing a biochip, and the like, in addition to various ink jet recording heads which are used in an image recording apparatus such as a printer.

In addition, the invention is not limited to a piezoelectric element which is installed in a liquid ejecting head which is represented by an ink jet recording head, and is applied to a piezoelectric element which is installed in other devices, for example, an ultrasonic device such as an ultrasonic transmitter, an ultrasonic motor, a pressure sensor, a pyroelectric sensor, or the like. In addition, the invention is similarly applied to a ferroelectric element such as a ferroelectric memory.

What is claimed is:

1. A flow path member comprising:

a cover which is divided into a base unit and a cover unit, the cover forming an interior space;

flow path grooves which are provided on one side of facing faces of the cover unit and the base unit which face each other, are extended in a first direction in the facing faces, and are aligned in a second direction intersecting the first direction;

an elastic sealing member which is arranged between the facing faces, and configures a part of a flow path wall face by covering the flow path grooves; and a plurality of abutting units which are provided on one side of the facing faces of the base unit and the cover unit, protrude toward the other side, come into contact with the other side of the facing faces, and reduces unevenness of crushing of the elastic sealing member between the base unit and the cover unit, wherein the plurality of abutting units are provided on both sides of the flow path groove in any one direction of the first direction and the second direction, and are extended along the other direction within the interior space and separate from an inner surface of a peripheral wall of each of the base unit and the cover unit, and wherein the base unit and the cover unit are fixed using fastening members, wherein the fastening members are positioned outside of a connecting position of the plurality of abutting units and near a plurality of second abutting units disposed about a peripheral of the peripheral wall of one of the base unit and the cover unit.

2. The flow path member according to claim 1, wherein the flow path groove is provided in a region which is surrounded with a first side in the first direction, and a second side in the second direction which is longer than the first side, and the abutting units are provided on both sides in a direction to which the second side is extended.

3. The flow path member according to claim 1, wherein an abutting unit of the plurality of abutting units is extended to the same dimension as at least a dimension of extending or aligning the flow path groove.

4. The flow path member according to claim 1, wherein a main body of the flow path member which has a layered structure in which flow paths of liquid are formed is provided inside the cover, and the main body of the flow path member includes at least one back-pressure control unit.

5. The flow path member according to claim 1, wherein an abutting unit of the plurality of abutting units comes into contact with the other side of the facing faces by protruding toward the other side is provided on one side of the facing faces of the cover unit and the base unit which face each other corresponding to a portion at which the fastening member is provided.

6. A liquid ejecting head comprising:

the flow path member according to claim 1.

7. A liquid ejecting head comprising:

the flow path member according to claim 2.

8. A liquid ejecting head comprising:

the flow path member according to claim 3.

9. A liquid ejecting head comprising:

the flow path member according to claim 4.

10. A liquid ejecting head comprising:

the flow path member according to claim 5.

11. A liquid ejecting apparatus comprising:

the liquid ejecting head according to claim 6.

12. A liquid ejecting apparatus comprising:

the liquid ejecting head according to claim 7.

13. A liquid ejecting apparatus comprising:

the liquid ejecting head according to claim 8.

14. A liquid ejecting apparatus comprising:

the liquid ejecting head according to claim 9.

15. A liquid ejecting apparatus comprising:

the liquid ejecting head according to claim 10.

16. A flow path member comprising:

a cover which is divided into a base unit and a cover unit, the cover forming an interior space;

flow path grooves which are provided on one side of facing faces of the cover unit and the base unit which face each other, are extended in a first direction in the facing faces, and are aligned in a second direction intersecting the first direction;

an elastic sealing member which is arranged between the facing faces, and configures a part of a flow path wall face by covering the flow path grooves; and a plurality of abutting units which are provided on one side of the facing faces of the base unit and the cover unit, protrude toward the other side, come into contact with the other side of the facing faces and reduces unevenness of crushing of the elastic sealing member between the base unit and the cover unit, wherein the plurality of abutting units are provided on both sides of the flow path groove in any one direction of the first direction and the second direction, and are extended along the other direction within the interior space and separate from an inner surface of a peripheral wall of each of the base unit and the cover unit, and wherein the base unit and the cover unit are fixed using fastening members, wherein the fastening members are positioned outside of a connecting position of the plurality of abutting units, with each of the fastening members extending through at least a portion of a second abutting unit of a plurality of second abutting units, the plurality of second abutting units being disposed about a peripheral of the peripheral wall of one of the base unit and the cover unit.

17. A flow path member comprising:

a cover which is divided into a base unit and a cover unit;

flow path grooves, forming an atmosphere opening path, which are provided on one side of facing faces of the cover unit and the base unit which face each other, are extended in a first direction in the facing faces, and are aligned in a second direction intersecting the first direction;

an elastic sealing member which is arranged between the facing faces, and configures a part of a flow path wall face of the atmosphere opening path by covering the flow path grooves; and a plurality of abutting units which are provided on one side of the facing faces of the base unit and the cover unit, protrude toward the other side, come into contact with the other side of the facing faces and reduces unevenness of crushing of the elastic sealing member between the base unit and the cover unit, wherein the plurality of abutting units are provided on both sides of the flow path groove in any one direction of the first direction and the second direction, and are extended along the other direction, and wherein the base unit and the cover unit are fixed using fastening members, wherein the fastening members are positioned outside of a connecting position of the plurality of abutting units.

* * * * *